US010350918B2

(12) United States Patent
Akahane et al.

(10) Patent No.: US 10,350,918 B2
(45) Date of Patent: Jul. 16, 2019

(54) TRANSPORT DEVICE AND PRINTING APPARATUS

(71) Applicant: SEIKO EPSON CORPORATION, Tokyo (JP)

(72) Inventors: Takashi Akahane, Miyata (JP); Junya Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/877,149

(22) Filed: Jan. 22, 2018

(65) Prior Publication Data

US 2018/0215179 A1 Aug. 2, 2018

(30) Foreign Application Priority Data

Jan. 30, 2017 (JP) ..... 2017-014829

(51) Int. Cl.
*B41J 15/16* (2006.01)
*B41J 13/00* (2006.01)
(Continued)

(52) U.S. Cl.
CPC ..... *B41J 15/165* (2013.01); *B41J 13/0027* (2013.01); *B65H 23/1806* (2013.01); *B65H 23/1888* (2013.01); *B65H 23/198* (2013.01); *B65H 23/1955* (2013.01); *B41J 11/007* (2013.01); *B65H 2301/4493* (2013.01); *B65H 2404/62* (2013.01); *B65H 2513/104* (2013.01); *B65H 2513/11* (2013.01);
(Continued)

(58) Field of Classification Search
CPC .... B41J 15/165; B41J 11/007; B41J 13/0027; B65H 23/1806; B65H 23/1888; B65H 23/1955; B65H 23/198
See application file for complete search history.

(56) References Cited

U.S. PATENT DOCUMENTS

2015/0225196 A1 8/2015 Hamano et al.
2016/0096384 A1* 4/2016 Kumai ..... B41J 15/165 347/104
(Continued)

FOREIGN PATENT DOCUMENTS

JP 2009-062150 3/2009
JP 2011-011889 1/2011
(Continued)

*Primary Examiner* — Jacob S Uhlenhake
(74) *Attorney, Agent, or Firm* — Workman Nydegger

(57) ABSTRACT

A transport device provided in a printing apparatus includes a transport mechanism as an example of a first transport unit and a winding unit that is disposed on a downstream side of the transport mechanism in a transport direction. The transport device includes a tensile force applying unit that has a tension bar as an example of a tensile force applying member that is biased toward a medium between the transport mechanism and the winding unit and applies tensile force to the medium. Furthermore, the transport device includes a control unit that independently and intermittently drives the transport mechanism and the winding unit. The control unit controls transport start timing of the winding unit to take place later than transport start timing of the transport mechanism and causes the transport mechanism and the winding unit to transport the medium in parallel.

18 Claims, 14 Drawing Sheets

(51) Int. Cl.

| | |
|---|---|
| ***B65H 23/18*** | (2006.01) |
| ***B65H 23/198*** | (2006.01) |
| ***B65H 23/195*** | (2006.01) |
| ***B65H 23/188*** | (2006.01) |
| *B41J 11/00* | (2006.01) |

(52) U.S. Cl.
CPC .. *B65H 2513/514* (2013.01); *B65H 2515/116* (2013.01); *B65H 2515/31* (2013.01); *B65H 2553/41* (2013.01); *B65H 2801/03* (2013.01)

(56) References Cited

U.S. PATENT DOCUMENTS

| | | | | |
|---|---|---|---|---|
| 2017/0050452 | A1 | 2/2017 | Hamano | |
| 2017/0072719 | A1* | 3/2017 | Tanami ..... | B41J 15/16 |
| 2017/0106682 | A1 | 4/2017 | Akahane et al. | |
| 2017/0173983 | A1 | 6/2017 | Kumai et al. | |

FOREIGN PATENT DOCUMENTS

| | | |
|---|---|---|
| JP | 2013-022744 | 2/2013 |
| JP | 2015-147394 | 8/2015 |
| JP | 2016-068511 | 5/2016 |
| JP | 2016-068514 | 5/2016 |
| JP | 2017-039248 | 2/2017 |
| JP | 2017-074738 | 4/2017 |
| JP | 2017-074739 | 4/2017 |

* cited by examiner

TRANSPORT DEVICE AND PRINTING APPARATUS

BACKGROUND

1. Technical Field

The present invention relates to a transport device that transports a long medium, such as a roll sheet, and a printing apparatus that includes the transport device.

2. Related Art

Examples of a printing apparatus that performs printing on a medium with a large size include one provided with a transport device that transports the medium in a so-called roll-to-roll scheme. Such a type of the transport device includes a transport unit (an example of a first transport unit) that transports a long medium supplied from a roll body and a winding unit (an example of a second transport unit) that winds the medium, on which printing has been performed by a printing unit, at a position on a downstream side of the transport unit in a transport direction of the medium. For example, JP-A-2013-22744 discloses a transport device that includes a tensile force applying unit (tensile force applying mechanism) that applies tensile force to the medium at a portion from the transport unit to the winding unit in order to cause the winding unit to stably wind the medium. The transport device includes a tensile force applying mechanism in which a tensile force applying member (tension bar) supported by a pair of arms biases the strip-shaped medium by the weight of itself and applies tensile force to the medium. The transport device causes the tensile force applying member to swing within a specific angle range and causes the tensile force in a predetermined range to act on the medium by controlling the winding unit using various sensors that detect that the tensile force applying member has reached an upper limit position and a lower limit position.

However, in the tensile force applying mechanism disclosed in JP-A-2013-22744, the medium at the portion between the transport unit and the winding unit is loosened first if the transport unit starts to transport the medium, and then the tensile force applying member drops onto the medium due to the weight of itself with slight delay. There is a risk that the tensile force applying member cannot follow the loosening of the medium at the time of the start of transport and excessive tensile force is applied to the medium when the tensile force applying member collides against the medium due to the bias force after being separated therefrom once. Such excessive tensile force induces deviation of the medium in, for example, at least one of the transport unit and the winding unit. Such a problem is not only for the configuration in which the tensile force applying member biases the medium by the weight of itself and is substantially a common problem for configurations in which the medium is biased in other schemes such as use of spring and the like.

SUMMARY

An advantage of some aspects of the invention is to provide a transport device and a printing apparatus capable of suppressing variations in tensile force applied to a medium at a portion between a first transport unit and a second transport unit to be small.

According to an aspect of the invention, there is provided a transport device including: a first transport unit; a second transport unit that is disposed on a downstream side of the first transport unit in a transport direction; a tensile force applying unit that has a tensile force applying member that is biased toward a medium between the first transport unit and the second transport unit and applies tensile force to the medium; and a control unit that independently and intermittently drives the first transport unit and the second transport unit, in which transport start timing of the second transport unit takes place later than transport start timing of the first transport unit, and the first transport unit and the second transport unit transport the medium in parallel.

In this configuration, since the transport start timing of the second transport unit takes place later than the transport start timing of the first transport unit, the medium is loosened at a portion between the first transport unit and the second transport unit due to the delay of the timing. Thereafter, the medium is transported by the first transport unit and the second transport unit in parallel. Therefore, the loosening amount of the medium does not greatly vary. The loosening amount at this time is sufficiently smaller than the loosening amount of the medium when the second transport unit is not driven and only the first transport unit is driven. Therefore, the moving distance until the tensile force applying member is brought into contact with the medium after the tensile force applying member starts to move by the bias of itself (including bias due to force of gravity, for example) becomes relatively short. The moving speed when the tensile force applying member is brought into contact with the medium decreases as the moving distance decreases. Therefore, the tensile force applying member cannot follow the loosening of the medium, collision (collision energy) caused when the tensile force applying member collides against the medium again after being separated therefrom once is alleviated, and tensile force caused in the medium is suppressed to be small. For example, it is possible to reduce transport deviation in the medium that is generated in at least one of the first transport unit and the second transport unit due to excessive tensile force applied to the medium when the tensile force applying member is brought into contact with the medium after being separated therefrom once at the time of starting transport of the medium. Therefore, it is possible to suppress variations in tensile force applied to the medium at the portion between the first transport unit and the second transport unit.

In the transport device, it is preferable that the control unit set a first transport speed at which the first transport unit transports the medium and a second transport speed at which the second transport unit transports the medium to be the same.

In this configuration, since the first transport speed and the second transport speed are the same, it is possible to set the loosening amount of the medium when the tensile force applying member cannot follow the loosening of the medium and collides against the medium again after being separated therefrom once to be sufficiently smaller than the loosening amount when the second transport unit is not driven and to be substantially constant. Since the tensile force applying member collides against the medium with the loosening amount maintained to be substantially constant, it is possible to alleviate the collision (collision energy) when the tensile force applying member collides against the medium and to further suppress variations in the collision.

In the transport device, it is preferable that there be a period during which a second transport speed of the second transport unit is higher than a first transport speed of the first transport unit, and that a first transport distance by which the first transport unit transports the medium until the period is completed be longer than a second transport distance by which the second transport unit transports the medium until the period is completed.

In this configuration, the loosening amount of the medium decreases, and the medium approaches the tensile force applying member in the period during which the second transport speed of the second transport unit is higher than the first transport speed of the first transport unit. Also, since the first transport distance by which the first transport unit transports the medium until the period is completed is longer than the second transport distance by which the second transport unit transports the medium until the period is completed, the medium is maintained to be loosened until the period is completed. Therefore, since the moving distance until the tensile force applying member is brought into contact with the medium after starting the movement due to the bias of itself becomes relatively short, it is possible to alleviate collision when the tensile force applying member collides against the medium.

In the transport device, it is preferable that the control unit set the second transport speed to be higher than the first transport speed and then set the second transport speed to be lower than the first transport speed.

In this configuration, the loosening amount of the medium is reduced by setting the second transport speed to be higher than the first transport speed, and the loosening amount of the medium is then increased by setting the second transport speed to be lower than the first transport speed. Therefore, the moving amount until the tensile force applying member is brought into contact with the medium can be reduced by the loosening amount of the medium being reduced, and thereafter, the medium moves in a direction in which the loosening amount of the medium increases, that is, a moving direction of the tensile force applying member. Therefore, it is possible to reduce a relative speed between the tensile force applying member and the medium, and if the tensile force applying member collides against the medium in this state, impact at the time of the collision is suppressed to be small.

In the transport device, it is preferable that the control unit set the transport start timing of the second transport unit to be later than the transport start timing of the first transport unit in a case of the first transport distance, by which the first transport unit transports the medium, being equal to or greater than a predetermined distance and does not drive the second transport unit in a case of the first transport distance being less than the predetermined distance.

In this configuration, the transport start timing of the second transport unit is set to be later than the transport start timing of the first transport unit in a case of the first transport distance, by which the first transport unit transports the medium, being equal to or greater than the predetermined distance. In contrast, since the second transport unit is not driven in a case of the first transport distance being less than the predetermined distance, it is possible to avoid an increase in tensile force of the medium, which is caused by the second transport unit being driven and pulling the medium at the portion between the first transport unit and the second transport unit. Therefore, it is possible to reduce a frequency of generation of transport deviation in which the medium is deviated at the first transport unit due to the increase in the tensile force of the medium.

In the transport device, it is preferable that the control unit perform control such that a second transport speed at which the second transport unit transports the medium follows variations in a first transport speed at which the first transport unit transports the medium.

In this configuration, since the second transport speed is made to follow the variations in the first transport speed, it is possible to suppress the loosening amount when the tensile force applying member collides against the medium to be relatively small and to suppress the variations in the loosening amount to be small even if the first transport speed varies.

In the transport device, it is preferable that transport stop timing of the first transport unit be the same as transport stop timing of the second transport unit.

In this configuration, since the transport spot timing of the first transport unit is the same as that of the second transport unit, the loosening of the medium does not increase or decrease after the stop of the transport. Therefore, it is possible to suppress variations in the tensile force, which is caused by the increase or decrease in the loosening of the medium in a state of being pressurized by the tensile force applying member, for example.

According to another aspect of the invention, there is provided a transport device including: a first transport unit; a second transport unit that is disposed on a downstream side of the first transport unit in a transport direction; a tensile force applying unit that has a tensile force applying member that is biased toward a medium between the first transport unit and the second transport unit and applies tensile force to the medium; and a control unit that independently and intermittently drives the first transport unit and the second transport unit, in which transport start timing of the first transport unit is the same as transport start timing of the second transport unit, and a second transport speed at which the second transport unit transports the medium is lower than a first transport speed at which the first transport unit transports the medium.

In this configuration, since the transport start timing of the first transport unit is the same as that of the second transport unit, and the second transport speed of the second transport unit is lower than the first transport speed of the first transport unit, loosening is formed in the medium at the portion between the first transport unit and the second transport unit. Since the loosening amount of the medium at this time is smaller than that in a case in which the second transport unit is not driven, the moving distance until the tensile force applying member collides against the medium after being separated therefrom once since the tensile force applying member starts to move becomes relatively short. As a result, it is possible to alleviate the impact when the tensile force applying member collides against the medium.

In the transport device, it is preferable that the second transport unit be a winding unit that winds the medium transported from the first transport unit, and that the control unit obtain an outer diameter of the medium wound by the winding unit and correct a winding speed as a second transport speed, at which the winding unit winds the medium, in accordance with the outer diameter of the wound medium.

In this configuration, since the winding speed (second transport speed) in which the winding unit winds the medium transported from the first transport unit is corrected in accordance with the outer diameter of the medium wound by the winding unit, it is possible to appropriately alleviate the impact when the tensile force applying member collides against the medium regardless of the outer diameter of the medium wound by the winding unit.

In the transport device, it is preferable that the control unit correct a second transport speed, at which the second transport unit transports the medium, in accordance with a position of the tensile force applying member.

In this configuration, since the second transport speed at which the second transport unit transports the medium is corrected in accordance with the position of the tensile force applying member, it is possible to appropriately alleviate the impact when the tensile force applying member collides against the medium.

In the transport device, it is preferable that the tensile force applying unit include a tensile force reducing unit that reduces bias force applied by the tensile force applying member to the medium.

In this configuration, since the tensile force applying unit includes a tensile force reducing unit for reducing the bias force applied by the tensile force applying member to the medium, the tensile force applying member relatively slowly moves as compared to a case of a configuration with no tensile force reducing unit when the medium is transported, loosening occurs therein, and the tensile force applying member starts to move in a biased direction. Therefore, although the tensile force applying member cannot follow the loosening of the medium at the time of starting the transport, and an event in which the tensile force applying member collides against the medium tends to occur, the impact when the tensile force applying member collides against the medium is alleviated by the control unit controlling the first transport unit and the second transport unit. As a result, it is possible to suppress generation of excessive tensile force in the medium.

According to still another aspect of the invention, there is provided a printing apparatus including: the aforementioned transport device; and a printing unit that performs printing on the medium that has been transported by the transport device.

In this configuration, since the printing apparatus includes the aforementioned transport device that transports the medium on which the printing unit has performed printing, it is possible to obtain the same effects as those of the aforementioned transport device. Therefore, it is possible to provide printed matters with high quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of the printing apparatus will be described with reference to drawings. The printing apparatus is a large-format printer (LFP) for performing printing (recording) on a long medium with a large size. In order to show the respective members in the following respective drawings in recognizable sizes, the scales of the respective members are shown in different sizes from actual sizes. For convenience of description, three axes, namely an X axis, a Y axis, and a Z axis, that orthogonally intersect one another are shown in FIGS. 1 to 4, the sides of the leading ends of the arrows showing axis directions represent "positive sides", and the sides of the base sides thereof represent "negative sides". The direction in parallel to the X direction is represented as an "X axis direction", the direction in parallel to the Y axis is represented as a "Y axis direction", and the direction in parallel to the Z axis is represented as a "Z axis direction".

Figure 1:
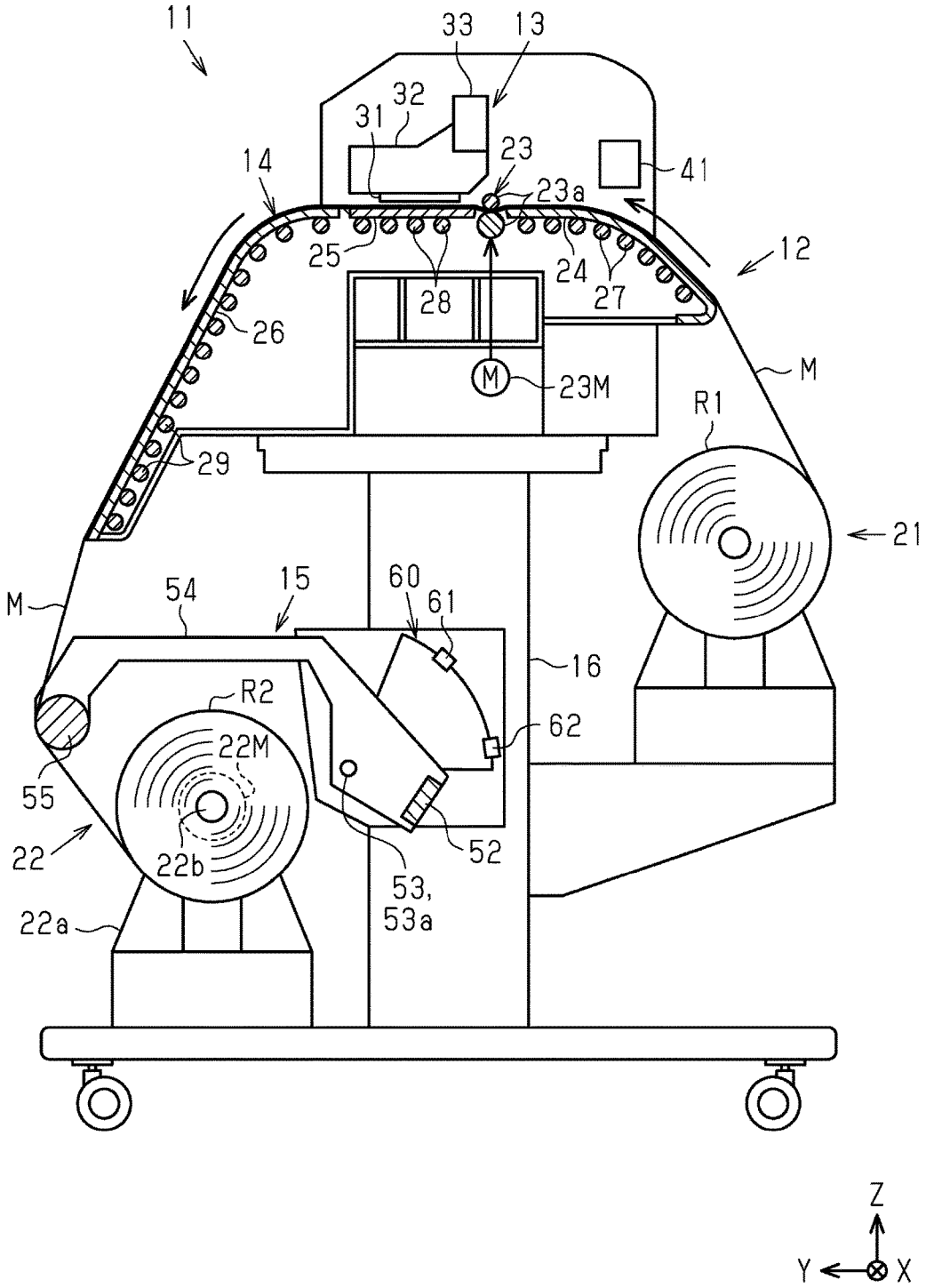
FIG. 1 is a sectional view illustrating an outline configuration of a printing apparatus according to a first embodiment.

First, a configuration of the printing apparatus will be described. The printing apparatus is an ink jet large-format printer, for example. As shown in FIG. 1, the printing apparatus 11 includes a transport device 12 that transports a medium M in a roll-to-roll scheme, a printing unit 13 that ejects ink as an example of liquid onto a predetermined region on the medium M and prints image, characters, or the like, a medium support unit 14 that supports the medium M, a tensile force applying unit 15, and a control unit 41 that controls these respective components. These respective components are supported by a main body frame 16 including a carriage. The medium M is a vinyl chloride-based film or the like with a width of about 64 inches, for example. In the embodiment, the upper and lower direction along the gravity weight direction corresponds to the Z axis direction, the direction in which the medium M is transported in the printing unit 13 corresponds to the Y axis direction, and the width direction of the medium M corresponds to the X axis direction.

The transport device 12 has a feeding unit 21 that feeds the medium M in a roll shape to the printing unit 13 in the transport direction (the array direction in the drawing) and a winding unit 22 that winds the medium M which has been subjected to printing by the printing unit 13 and has then been fed thereto. The transport device 12 has a transport mechanism 23 that transports the medium M in the course of a transport path between the feeding unit 21 and the winding unit 22. The transport mechanism 23 includes a pair of transport rollers 23*a* and a transport motor 23M that outputs rotation power to the pair of transport rollers 23*a*. Although one pair of transport roller 23*a* is provided in the example of the transport mechanism 23 illustrated in FIG. 1, the transport mechanism 23 may have a plurality of pairs of transport rollers 23*a*. The transport mechanism 23 is not limited to the roller type transport mechanism and may at least partially have a belt type transport mechanism that has a transport belt for placing the medium M thereon and transporting the medium M. In the embodiment, the transport mechanism 23 corresponds to an example of the first transport unit, and the winding unit 22 corresponds to an example of the second transport unit.

A roll body R1 around which the unused medium M is wound and overlaid in a cylindrical shape is held by the feeding unit 21. The feeding unit 21 is filled with the roll body R1 such that roll bodies R1 with different sizes with different widths (lengths in the X axis direction) and different numbers of windings of the medium M can be exchanged. Then, the medium M is unwound from the roll body R1 and is then fed to the printing unit 13 by the feeding unit 21 rotating the roll body R1 in the counterclockwise direction in FIG. 1 using power from the feeding motor, which is not shown in the drawing. The winding unit 22 winds the medium M, on which the printing unit 13 has performed printing, in a cylindrical shape and forms a roll body R2. The winding unit 22 includes a pair of holders 22*a* that have a pair of winding shafts 22*b* for supporting a cylindrical core material for winding the medium M and forming the roll material R2 and a winding motor 22M that outputs power for rotating the pair of winding shafts 22*b*. The medium M is wound around the core material supported by the winding shafts 22*b*, and the roll material R2 is formed by the winding motor 22M being driven to rotate the winding shafts 22*b* in the counterclockwise direction in FIG. 1.

The printing unit 13 includes a recording head 31 capable of ejecting ink toward the medium M and a carriage moving unit 33 that reciprocates a carriage 32 with the recording head 31 placed thereon in the direction (X axis direction) that intersects the transport direction. The recording head 31 has a plurality of nozzles and is configured to be able to eject the ink from the respective nozzles. Then, images, characters, or the like are printed on the medium M by repeating main-scanning for causing the recording head 31 to eject the ink and sub-scanning for causing the transport device 12 to transport the medium M in the transport direction while the carriage moving unit 33 reciprocates the carriage 32 in the X axis direction.

The medium support unit 14 has a first support unit 24 that is configured to be able to support the medium M in the transport path of the medium M and is provided between the feeding unit 21 and the transport mechanism 23, a second support unit 25 that is disposed to face the printing unit 13, and a third support unit 26 that is provided between an end of the second support unit 25 on a downstream side and the winding unit 22.

The printing apparatus 11 includes a first heater (preheater) 27 that heats the medium M, a second heater 28, and a third heater (after-heater) 29. A surface, which supports the medium M, of the medium support unit 14 is heated by heat conduction, and the medium M is heated from the rear side of the medium M by the control unit 41 driving the first, second, and third heater 27, 28, and 29. The first heater 27 heats the first support unit 24 and preheats the medium M on an upstream side (-Y axis side) of the printing unit 13 in the transport direction. The heater 28 heats the second support unit 25 and heats the medium M in an ejection region of the printing unit 13. The third heater 29 heats the third support unit 26 and completely dries and fixes the ink that has landed on the medium M and has not yet been dried at least before the winding unit 22 winds the medium 22 by heating the medium M on the third support unit 26.

The tensile force applying unit 15 applies tensile force to the medium M at a portion between the transport mechanism 23 and the winding unit 22. The tensile force applying unit 15 according to the embodiment pressurizes a portion that extends to the air between an end of the medium support unit 14 on the downstream side in the transport direction (that is, the lower end of the third support unit 26) and the winding unit 22 and applies tensile force to the medium M. The tensile force applying unit 15 has a tension bar 55 as an example of the tensile force applying member that is turned about a turning shaft 53, and applies tensile force to the medium M by the tension bar 55 being brought into contact with the rear surface of the medium M, on which images or the like have been printed by the printing unit 13.

Figure 2:
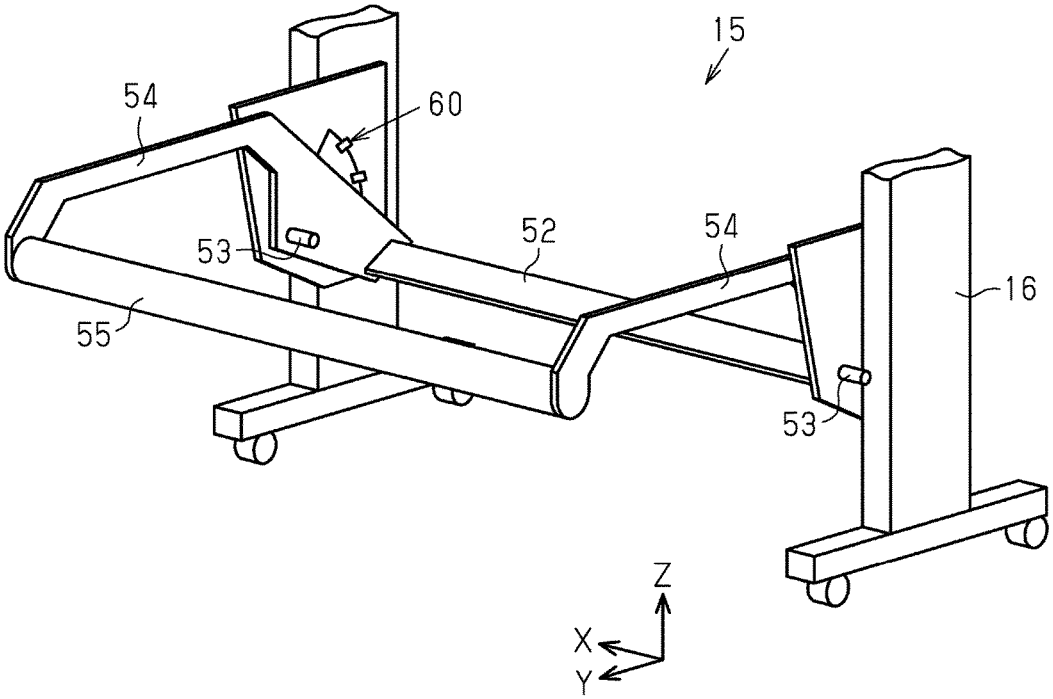
FIG. 2 is a perspective view illustrating a configuration of a tensile force applying unit.

Next, a configuration of the tensile force applying unit 15 will be described with reference to FIGS. 1 and 2. As shown in FIGS. 1 and 2, the tensile force applying unit 15 includes a pair of arms 54 that can be turned about the turning shaft 53, the tension bar 55 that is supported at ends of the pair of arms 54 and can be brought into contact with the medium M, and a counter weight 52 as an example of the tensile force reducing unit that are supported by the other ends of the pair of arms 54. The tension bar 55 and the counter weight 52 are formed of long members that couple the pair of arms 54 at the base portions and leading end portions thereof in the width direction (Y axis direction).

The tension bar 55 has a cylindrical shape and is formed to be longer than the width of the medium M in the width direction. The counter weight 52 has a rectangular parallelepiped shape and is formed to have the length that is substantially the same as that of the tension bar 55. The tension bar 55 and the counter weight 52 form a weight portion of the tensile force applying unit 15. The pair of arms are supported by the turning shaft 53 provided at the main body frame 16 between the tension bar 55 and the counter weight 52 provided at both ends of the respective arms 54 in the longitudinal direction. In this manner, the tensile force applying unit 15 can be turned about the turning shaft 53, and tensile force is applied to the medium M by the tension bar 55 being brought into contact with the rear surface of the medium M, on which images or the like have been printed by the printing unit 13.

The pair of arms 54 form a shape curved in a shape projecting toward the upper side in the vertical direction (Z axis direction). Since this shape enables the tension bar 55 to be brought into contact with the medium M while avoiding the holder 22*a* that supports the winding shaft 22*b* provided at both ends of the winding unit 22 in the width direction of the medium M (X axis direction) for winding the medium M, it is possible to reduce the dimension of the tensile force applying unit 15 in the width direction. In this manner, it is possible to reduce a frequency at which the tensile force applying unit 15 is brought into contact with another object such as an operator. Furthermore, since the tension bar 55 and the counter weight 52 are formed of long members coupling the pair of arms 54, twist rigidity of the tensile force applying unit 15 is improved, and it is possible to suppress deformation of the tensile force applying unit 15 even in a case in which the tensile force applying unit 15 is brought into contact with another object.

Next, a turning range of the tension bar 55 will be described with reference to FIGS. 3 to 5. The printing apparatus 11 includes a sensor unit 60 for obtaining an upper limit position P1 and a lower limit position P2 of the tension bar 55. The sensor unit 60 has an upper limit sensor 61, a lower limit sensor 62, and a flag plate 63. The flag plate 63 forms a fan shape around the turning shaft 53 and is provided at the arms 54. The upper limit sensor 61 and the lower limit sensor 62 are transmissive photo sensors and a provided at positions at which an outer peripheral edge (arc portion) of the flag plate 63 can be detected.

Next, a configuration of the lower limit sensor 62 will be described. Since a configuration of the upper limit sensor 61 is the same as that of the lower limit sensor 62, the description thereof will be omitted. As shown in FIG. 5, the lower limit sensor 62 includes a light emitting unit 65 that has a light emitting element or the like for emitting light and a light receiving unit 66 that has a light receiving element or the like for receiving light. The light emitting unit 65 and the light receiving unit 66 are provided so as to face one another. The lower limit sensor 62 is provided at the main body frame 16. The flag plate 63 is disposed so as to be able to be turned between the light emitting unit 65 and the light receiving unit 66. FIG. 3 shows a state in which light emitted by the light receiving unit 65 is blocked by the flag plate 63 and is not received by the light receiving unit 66. At this time, the lower limit sensor 62 outputs an "OFF" signal. The flag plate 63 is turned about the turning shaft 53 in the counterclockwise direction along with the turning of the arms 54 (tensile force applying unit 15) from the state shown in FIG. 3. If the lower limit end 63*a* of the flag plate 63 reaches the position shown in FIG. 4 from the position shown in FIG. 3, the flag plate 63 deviates from between the light emitting unit 65 and the light receiving unit 66 and is brought into a state in which the light emitted by the light emitting unit 65 is received by the light receiving unit 66. At this time, the lower limit sensor 62 outputs an "ON" signal.

Figure 3:
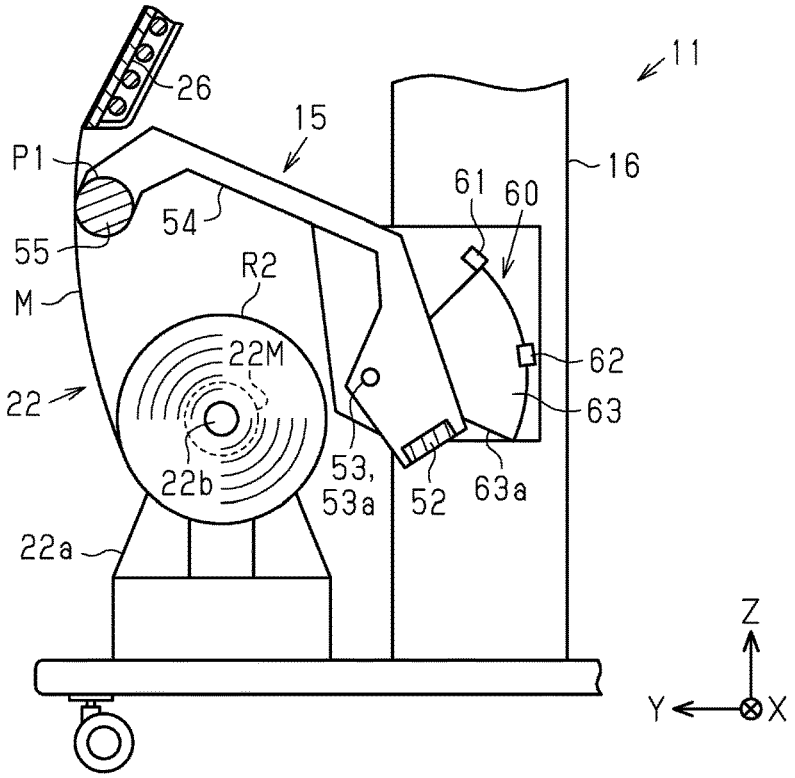
FIG. 3 is a side sectional view illustrating an upper limit position of a tension bar.
Figure 4:
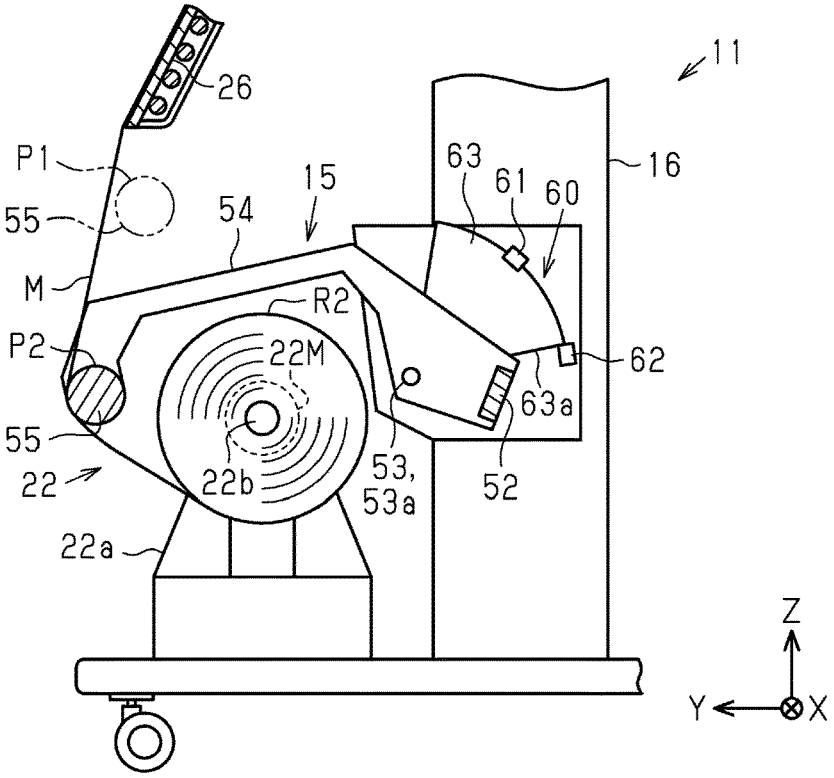
FIG. 4 is a side sectional view illustrating a lower limit position of the tension bar.
Figure 5:
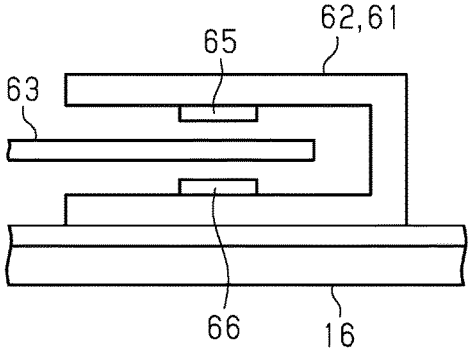
FIG. 5 is a sectional view illustrating a configuration of a lower limit sensor.

The tensile force applying unit 15 applies tensile force to the medium M in a range in which the tension bar 55 is located from the upper limit position P1 shown in FIG. 3 to the lower limit position P2 shown in FIG. 4. Specifically, the medium on which the printing unit 13 has performed printing is transported by the drive of the transport mechanism 23 and is sequentially discharged from an end of the medium support unit 14 on the downstream side. In this manner, the tension bar 55 located at the upper limit position P1 is gradually turned (lowered) about the turning shaft 53 toward the lower position P2 due to the weight of itself as the length of the medium M between a leading end of the third support unit 26 and the winding unit 22 gradually increases. If the tension bar 55 reaches the lower limit position P2, the flag plate 63 that is turned along with the arms 54 is separated from between the light emitting unit 65 and the light receiving unit 66 of the lower limit sensor 62, and the lower limit sensor 62 outputs an "ON" signal.

The control unit 41 receives the "ON" signal output from the lower limit sensor 62 and then drives the winding motor 22M to cause the winding unit 22 to wind the medium M. In this manner, tensile force is further applied to the medium M, and force of lifting the tension bar 55 is caused. The tension bar 55 located at the lower limit position P2 is turned (lifted) about the turning shaft 53 toward the upper limit position P1 as the medium M is wound by the winding unit 22 and the length of the medium M between the leading end of the third support unit 26 and the winding unit 22 decreases. If the tension bar 55 reaches the upper limit position P1, the flag plate 63 that is turned along with the arms 54 is separated from between the light emitting unit 65 and the light receiving unit 66 of the upper limit sensor 61, and the upper limit sensor 61 outputs an "ON" signal. The control unit 41 receives the "ON" signal output from the upper limit sensor 61 and then stops driving the winding motor 22M to cause the winding unit 22 to complete the winding operation. The tensile force applying unit 15 repeats the aforementioned operations to pressurize the medium M such that the tension bar 55 is brought into contact with the rear surface of the medium M in the range between the upper limit position P1 and the lower limit position P2, thereby applying predetermined tensile force to the medium M. In the embodiment, the transport mechanism 23 performs the transport operation a plurality of times while the tension bar 55 moves from the upper limit position P1 to the lower limit position P2. That is, the winding unit 22 performs the winding operation once while the transport mechanism 23 performs the transport operation a plurality of times.

Figure 7:
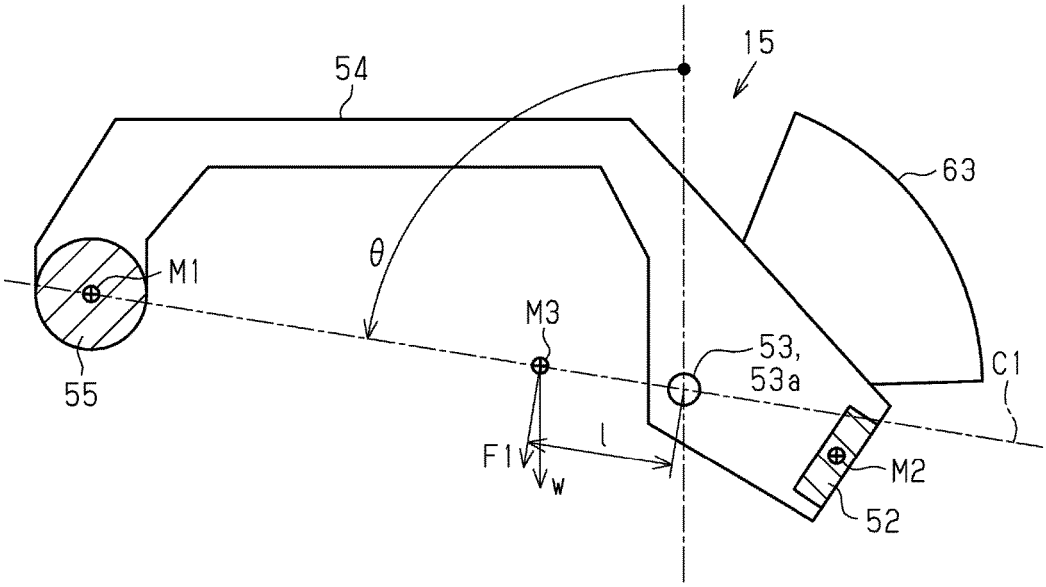
FIG. 7 is a side sectional view illustrating a configuration of the tensile force applying unit.

Next, a gravity center position of the tensile force applying unit 15 will be described with reference to FIG. 7. FIG. 7 shows a gravity center position M1 of the tension bar 55, a gravity center position M2 of the counter weight 52, and a gravity center position M3 of the entire tensile force applying unit 15. As shown in FIG. 7, the gravity center position M2 of the counter weight 52 is provided below a straight line C1 that connects a turning support point 53*a* of the arms 54 and the gravity center position M1 of the tension bar 55 in the vertical direction. In this manner, it is possible to cause the gravity center position M3 of the entire tensile force applying unit 15 to approach the straight line C1 that connects the turning support point 53*a* and the gravity center position M1 of the tension bar 55 even if the arms 54 have curved shapes curved projecting toward the upper side in the vertical direction. Since the gravity center position M2 of the counter weight 52 is provided on the side opposite to the gravity center position M1 of the tension bar 55 with respect to a vertical line passing through the turning support point 53*a*, the gravity center position M3 of the entire tensile force applying unit 15 approaches the side of the turning support point 53*a*, and the distance 1 between the gravity center position M3 and the turning support point 53*a* decreases.

Next, a turning range in which the tension bar 55 can apply the tensile force to the medium M will be described with reference to FIGS. 7 and 8. In the following description, an angle between the straight line C1 that connects the turning support point 53*a* and the gravity center position M1 of the tension bar 55 and the vertical line in FIG. 7 will be regarded as θ, and θ will be referred to as an inclination angle (turning angle) of the arms 54.

Figure 8:
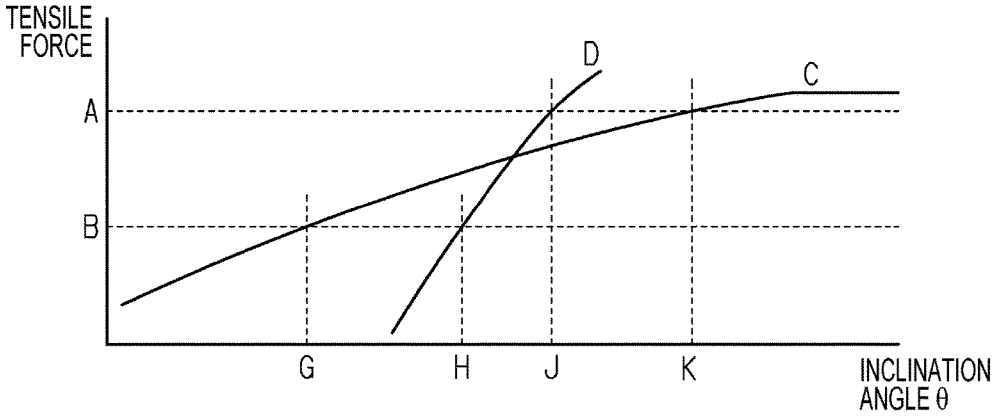
FIG. 8 is a graph illustrating a relationship between an inclination angle of an arm and tensile force applied to a medium.

In FIG. 8, the horizontal axis represents the inclination angle θ of the arms 54, and the vertical axis represents tensile force applied to the medium M when the tension bar 55 located at the inclination angle θ pressurizes the medium M. In the drawing, the broken line A represents predetermined upper limit tensile force to be applied to the medium M, the broken line B represents predetermined lower limit tensile force to be applied to the medium M. The curve C represents tensile force to be applied to the medium M by the tensile force applying unit 15 according to the embodiment that has the counter weight 52, and the curve D represents tensile force to be applied to the medium M by a tensile force applying unit according to a comparative example that does not have the counter weight 52.

A load F with which the medium M is pressurized for applying the tensile force to the medium M is represented by the following equation, where w represents the mass of the tensile force applying unit 15, and l represents the distance between the turning support point 53*a* and the gravity center position M3 of the tensile force applying unit 15 (see FIG. 7).

$$F=w\cdot l\cdot \sin\theta \quad (1)$$

It is possible to find from Equation 1 that the load F varies depending on the inclination angle θ and the amount of variations in the load F decreases in proportion to the distance 1 as the distance 1 decreases. In this manner, variations in the tensile force applied to the medium M also decreases. Since the distance 1 between the turning support point 53*a* of the tensile force applying unit 15 and the gravity center position M3 of the tensile force applying unit 15 according to the embodiment is significantly shorter than the corresponding distance in the tensile force applying unit according to the comparative example that does not have the counter weight 52, the amount of change in the tensile force also significantly decreases in comparison between the curve C according to the embodiment and the curve D according to the comparative example.

An inclination angle G represents an intersection between the curve C and predetermined lower limit tensile force B and represents an inclination angle of the arms 54 when the tension bar 55 is located at the upper limit position P1. An inclination angle K represents an intersection between the curve C and an upper limit tensile force A and represents an inclination angle of the arms 54 when the tension bar 55 is located at the lower limit position P2. The range from the inclination angle G and the inclination angle K represents the turning range of the tension bar 55 when the winding unit 22 winds the medium M. Also, it is possible to maximize the turning range of the tension bar 55 to cause the inclination angle G and the inclination angle K to coincide with physical turning limits at which the tension bar 55 can be brought into contact with the medium M.

In FIG. 8, the turning range of the tension bar when the winding unit 22 winds the medium M is the range of the inclination angle θ from an inclination angle H to an inclination angle J in the tensile force applying unit according to the comparative example. As is known from the comparison between the curve C and the curve D in FIG. 8, it is possible to further widen the turning range of the tension bar 55 in the tensile force applying unit 15 according to the embodiment than the tensile force applying unit according to the comparative example.

Here, loosening of the medium M will be described with reference to FIG. 8. Force that rotates the pair of transport rollers 23*a* forming the transport mechanism 23 shown in FIG. 1 and pressing the pair of transport rollers 23*a* in the transport direction is applied to the medium M. Also, force that pulls the medium M in the transport direction by rotating the tensile force applying unit 15 and the winding unit 22 is applied to the medium M. The pressing force and the pulling force transport the medium M from the transport mechanism 23 toward the winding unit 22.

Next, an electric configuration of the printing apparatus 11 will be described with reference to FIG. 6. The control unit 41 is a control unit for controlling the printing apparatus 11. The control unit 41 includes a control circuit 44, an interface (I/F) 42, a central processing unit (CPU) 43, and a storage unit 45. The interface 42 transmits and receives data between an external apparatus 46 that handles images, such as a computer or a digital camera, and the printing apparatus 11. The CPU 43 is a computation processing device that processes input signals from a detector group 47, a first rotation detector 48, a second rotation detector 49, and the like and controls the entire printing apparatus 11.

The CPU 43 controls the transport mechanism 23 that transports the medium M in the transport direction, the carriage moving unit 33 that moves the carriage 32 in the direction intersecting the transport direction, the recording head 31 that ejects the ink toward the medium M, the winding unit 22 that winds the medium M, and the respective devices that are not shown in the drawing by a control circuit 44 based on print data received from the external device 46. Although the feeding unit 21 is omitted in FIG. 6, the control unit 41 controls drive of a feeding motor that forms the feeding unit 21 and is not shown in the drawing.

The storage unit 45 is for securing a region for storing programs of the CPU 43, a work region, and the like, and has storage elements such as a random access memory (RAM), and an electrically erasable programmable read-only memory (EEPROM). The detector group 47 includes the upper limit sensor 61 for detecting the upper limit position P1 of the tension bar 55 and the lower limit sensor 62 for detecting the lower limit position P2 of the tension bar 55. The first rotation detector 48 detects rotation of the pair of transport rollers 23*a*. The second rotation detector 49 detects rotation of the winding unit 22 (winding shaft 22*b*). The respective rotation detectors 48 and 49 are formed of rotary encoders, for example, and output rotation detection signals including pulses of numbers in proportion to the amounts of rotation. The control unit 41 controls a transport speed Vf as an example of the first transport speed, at which the transport mechanism 23 transports the medium M, based on the rotation detection signal from the first rotation detector 48. Also, the control unit 41 controls a winding speed Vw as an example of the second transport speed, at which the winding unit 22 transports (winds) the medium M, based on the rotation detection signal from the second rotation detector 49. In addition, the respective amounts of rotation may be obtained from a rotation command value of the transport motor 23M and a rotation command value of the winding motor 22 M instead of the respective rotation detectors 48 and 49.

The storage unit 45 stores data of an acceleration/deceleration profile for controlling the speeds of the transport motor 23M and the winding motor 22M. That is, if the amount of transport of the medium M is set, then the control unit 41 reads the acceleration/deceleration profile corresponding to the amount of transport from the storage unit 45. The control unit 41 controls acceleration of the transport motor 23M based on the acceleration profile. If the drive speed of the transport motor 23M reaches a target speed, the speed of the transport motor 23M is controlled to be constant. If the medium M transported by the transport mechanism 23 reaches a deceleration start position, and the amount of drive from a start of driving the transport motor 23M and the amount of drive at the time of starting deceleration corresponding to the deceleration start position can be reached, deceleration control is performed based on the deceleration profile. As a result, the transport motor 23M is decelerated and stopped, the medium that has transported by the transport mechanism 23 stops at a target stop position. The speed control for the winding motor 22 M is basically the same as above, and if the amount of winding (the amount of transport) is set, then the speed control of acceleration, maintaining of the constant speed, and deceleration is performed in accordance with the acceleration/deceleration profile.

Figure 9:
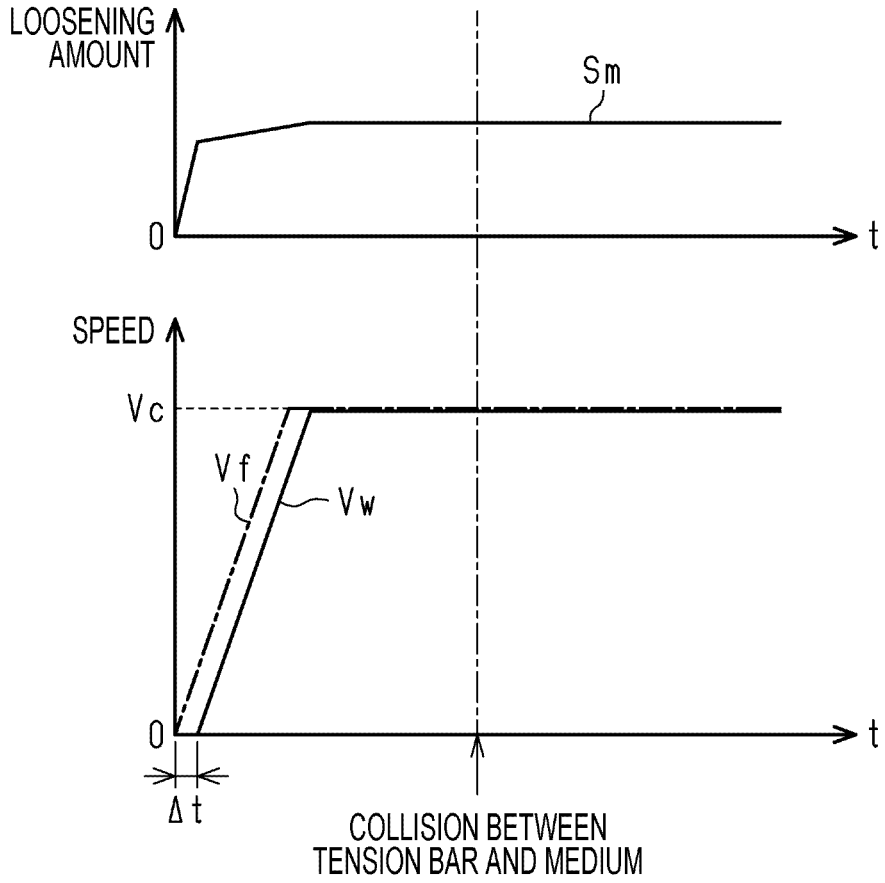
FIG. 9 is a graph illustrating temporal changes in a transport speed, a winding speed, and a loosening amount in tensile force adjustment control.
Figure 13:
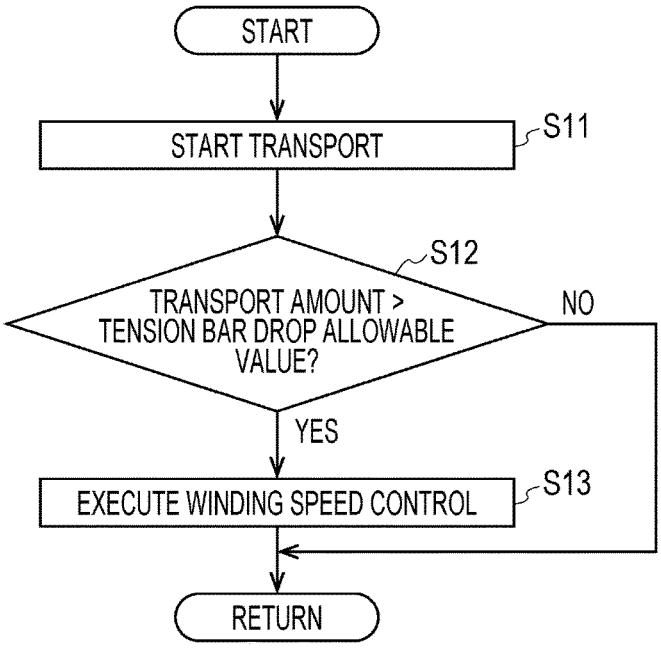
FIG. 13 is a flowchart illustrating the tensile force adjustment control.

In the embodiment, the storage unit 45 stores a program for tensile force adjustment control shown by the flowchart in FIG. 13 and a speed control profile that is partially shown by the graph in the lower section in FIG. 9, which is used in the tensile force adjustment control. The CPU 43 uses the speed control profile when the speed of the winding motor 22M that forms the winding unit 22 is controlled. If the amount of transport of the medium M by the transport mechanism 23 is set, then the control unit 41 determines whether or not to perform the tensile force adjustment control. In a case of performing the tensile force adjustment control, a target amount of winding (second transport distance) when the winding motor 22M is controlled corresponding to the target amount of transport (first transport distance) when the transport motor 23M is controlled is set. The target amount of winding is calculated as a value that is smaller than the target amount of transport. In a case in which the CPU 43 controls the winding speed based on the speed control profile in the tensile force adjustment control, and the transport operation by the target amount of transport is performed based on the acceleration/deceleration profile for the transport, for example, the target amount of winding is obtained such that stop timing of the transport operation is the same as stop timing of the winding operation (transport stop timing). In the tensile force adjustment control, the winding operation by the winding unit 22 may be stopped at earlier timing than that of the transport operation by the transport mechanism 23, and the transport stop timing of the winding unit 22 may be set to be earlier than the transport stop timing of the transport mechanism 23.

The tension bar 55 is biased at a predetermined degree of acceleration (gravity acceleration in the example). In a case in which the tension bar 55 is configured to be turned by the weight of itself (self-weight turning scheme), the tension bar 55 more slowly starts to move as compared to the transport speed of the medium M if the transport mechanism 23 starts to transport the medium M. In a case in which the gravity center of the tension bar 55 is higher than the turning support point 53*a*, in particular, the tension bar 55 quite slowly starts to move. Therefore, the tension bar 55 cannot move in the biased direction (the turning direction on the lowered side) so as to follow the loosening of the medium M at the time of starting the transport of the medium M, and the tension bar 55 is once separated from the medium M and then collides against the separated medium M.

Here, the tension bar 55 that has started to move is gradually accelerated by the bias force (weight) of itself. Therefore, the moving speed when the tension bar 55 collides against the medium M increases as the moving distance (the length of moving on a turning path) or the moving time until the tension bar 55 is brought into contact with the medium M again after being separated therefrom because the tension bar 55 cannot follow the loosening of the medium M from the moving start position increases. In a case in which the winding unit 22 is configured not to be driven and the amount of transport by the transport mechanism 23 is relatively large, for example, loosening of a relatively large loosening amount is formed. Therefore, the moving distance (the amount of turning) until the tension bar 55 is brought into contact with the medium M again tends to be long, and the moving speed when the tension bar 55 is brought into contact with the medium M is relatively high. Therefore, in a case in which the amount of transport is relatively large, the impact (impact energy) when the tension bar 55 collides against the medium M becomes relatively large, and excessive tensile force is generated in the medium M.

Thus, the control unit 41 according to the embodiment performs the tensile force adjustment control for controlling the transport mechanism 23 and the winding unit 22 in order to suppress the tensile force caused when the tension bar 55 collides against the medium M to be small within a predetermined range. Specifically, the control unit 41 adjusts the loosening amount of the medium M to be smaller than that in a case in which the tensile force adjustment control is not performed, by controlling the transport mechanism 23 and the winding unit 22. Here, the transport start timing and the transport speed Vf by the transport mechanism 23 depend on printing start timing and a printing speed. The control unit 41 adjusts the loosening amount of the medium M to be relatively small by controlling the transport start timing and the winding speed Vw of the winding unit 22 relative to the transport start timing and the transport speed Vf of the transport mechanism 23.

FIG. 9 shows content of the tensile force adjustment control performed by the control unit 41 when the transport mechanism 23 performs the transport operation once. The graph in the upper section in FIG. 9 shows temporal changes in a loosening amount Sm of the medium M after the transport operation is started, and the graph in the lower section in the drawing shows temporal changes in the transport speed Vf in which the transport mechanism 23 transports the medium M and in the winding speed Vw in which the winding unit 22 winds the medium M. The one-dotted chain line in the graph in the lower section represents the transport speed Vf of the transport mechanism 23, and the solid line represents the winding speed Vw of the winding unit 22.

As shown by the graph in the lower section of FIG. 9, the transport start timing (rising of the winding speed Vw) of the winding unit 22 takes place later than the transport start timing (rising of the transport speed Vf) of the transport mechanism 23, and the transport mechanism 23 and the winding unit 22 transport the medium M in parallel. In the example, in particular, the control unit 41 sets the transport speed Vf to be the same as the winding speed Vw. That is, the same speed profile is set for the transport mechanism 23 and the winding unit 22. Therefore, although the transport start timing of the winding unit 22 takes place later than that of the transport mechanism 23 only by delay time Δtm, the degree of acceleration in an acceleration range after the start of transport is the same as the degree of deceleration in a deceleration range, which is not shown in the drawing, and further, the constant speed Vc (transport speed) in a constant range is the same value. The delay time Δt is set to such time that the drive of the winding unit 22 can be started before the tension bar 55 cannot follow the loosening of the medium M and is brought into contact with the medium M again after being separated therefrom once in a case in which the transport mechanism 23 starts to transport the medium M.

The control unit 41 executes the aforementioned tensile force adjustment control in a case in which the amount of transport Lf (an example of the first transport distance) by which the transport mechanism 23 transports the medium M is equal to or greater than a tension bar drop allowable value Lo (an example of the predetermined distance). In contrast, in a case in which the amount of transport Lf is less than the tension bar drop allowable value Lo, the control unit 41 does not execute the tensile force adjustment control and does not drive the winding unit 22. Here, the reason that the tensile force adjustment control is performed in the case in which the amount of transport Lf is equal to or greater than the tension bar drop allowable value Lo is that there is a risk that the loosening amount of the medium M becomes large and excessive tensile force is generated when the tension bar 55 collides against the medium M if the winding unit 22 is not driven, and that this situation is to be avoided. The reason that the tensile force adjustment control is not performed in the case in which the amount of transport Lf is less than the tension bar drop allowable value Lo is that the loosening amount of the medium M is relatively small and excessive tensile force is not generated when the tension bar 55 collides against the medium M even if the winding unit 22 is not driven. The tension bar drop allowable value Lo is a value corresponding to the amount of transport Lf by which the minimum loosening amount can be generated from among loosening amounts by which excessive tensile force is generated when the tension bar 55 collides against the medium M.

In the embodiment, the transport stop timing of the transport mechanism 23 is set to be the same as that of the winding unit 22. That is, if the medium M that the transport mechanism 23 transports approaches the target stop position and reaches the deceleration start position, then the control unit 41 simultaneously starts the deceleration of the transport motor 23M and the winding motor 22M. Therefore, the transport motor 23M and the winding motor 22M decelerate with the same degree of deceleration in accordance with the same deceleration profile, the winding operation of the winding unit 22 is stopped at the same time as the timing when the transport operation of the transport mechanism 23 is stopped and the medium M is stopped at the target stop position. Since the transport operation of the transport mechanism 23 and the winding operation of the winding unit 22 are completed at the same time as described above, the amount of transport Lf is greater than the amount of winding Lw by the amount of transport that substantially corresponds to the delay time Δt. Therefore, if the target amount of transport Lf is set, then the control unit 41 determines, as a target amount of winding, a value obtained by subtracting the amount of transport corresponding to the delay time Δt from the target amount of transport Lf.

The control unit 41 may further perform at least one of the following two kinds of control together. The CPU 43 obtains the loosening amount necessary for suppressing the relative speed when the tension bar 55 is brought into contact with the medium M after being separated therefrom once to be small within a predetermined range, by calculation or with reference to table data. Then, the transport start timing and the winding speed Vw of the winding unit 22 (winding motor 22M) are controlled relative to the transport start timing and the transport speed Vf of the transport mechanism 23 (transport motor 23M) so as to be able to obtain the loosening amount.

Since the tension bar 55 more slowly starts to move as the moving start position is higher if the inclination angle θ that defines the moving start position of the tension bar 55 is equal to or less than 90 degrees, the moving distance of the tension bar 55 increases, and the impact when the tension bar 55 collides against the medium M increases. Therefore, the control unit 41 executes the tensile force adjustment control in a case in which the moving start position of the tension bar 55 is equal to or higher than a predetermined height while the control unit 41 does not perform the tensile force adjustment control in a case in which the moving start position of the tension bar 55 is less than the predetermined height.

Next, operations of the printing apparatus 11 will be described. As shown in FIG. 1, the transport mechanism 23 is driven and transports the medium M while the printing unit 13 is performing printing on the medium M. For the loosening generated in the medium M at the portion between the medium support unit 14 and the roll body R2 due to the transport of the medium M, the tension bar 55 is lowered by the weight of itself, and the bias force thereof pressurizes the medium M, thereby applying the tensile force to the medium M. The winding unit 22 is driven every time transport mechanism 23 performs the transport operation a plurality of times and the tension bar 55 reaches the lower limit position P2 from the upper limit position P1. The length of the medium M at the portion between the end of the medium support unit 14 on the downstream side (the leading end of the third support unit 26) and the roll body R2 decreases, and the tension bar 55 is wound upward by the winding unit 22 winding the medium M around the roll body R2. If the sensor unit 60 detects that the tension bar 55 has reached the upper limit position P1 by the winding, the drive of the winding unit 22 is stopped. The transport operation of the transport mechanism 23 and the winding operation of the winding unit 22 are performed in the state in which the tension bar 55 applies the tensile force to the medium M at the portion between the end of the medium support unit 14 on the downstream side and the roll body R2 during the printing. In the embodiment, the tensile force adjustment control of alleviating the tensile force applied by the tension bar 55 in an initial stage after the transport operation is started is performed by the winding unit 22 performing the winding operation in parallel to the transport operation of the transport mechanism 23 in addition to the aforementioned winding control of the winding unit 22 based on the detection result of the sensor unit 60.

Incidentally, if the transport mechanism 23 starts to transport the medium M in the state in which the tension bar 55 is stopped at a position of equal to or higher than the predetermined height between the upper limit position P1 and the lower limit position P2, loosening occurs in the medium M at the portion between the end of the medium support unit 14 on the downstream side and the roll body R2 first. Since the tensile force applying unit 15 according to the embodiment has the counter weight 52, the gravity center position is located relatively on the side of the turning shaft 53, and inertia becomes relatively larger as compared with those in the comparative example in which no counter weight 52 is provided. Therefore, the tension bar 55 more slowly starts to drop as compared with the tension bar of the tensile force applying unit in the comparative example in which inertial is relatively small. The transport speed of the medium M y the transport mechanism 23 is relatively higher in response to a requirement for increase in the print speed. Therefore, the drop distance until the tension bar 55 drops on the medium M from the moving start position when the transport operation is started tends to be relatively longer than that of the tensile force applying unit in the comparative example. Since the increase in the drop distance leads to an increase in the dropping speed (collision speed) when the tension bar 55 drops the medium M, this becomes a reason that excessive tensile force is generated in the medium M.

If the tension bar 55 starts to slowly drop, elapse time (time necessary for dropping) until the tension bar 55 drops on the medium M tends to increase. Since the loosening amount of the medium M increases when the tension bar 55 drops on the medium M if the time necessary for dropping increases, the drop distance increase. Also, since the tension bar 55 is accelerated by the bias force (weight in the example) of itself while dropping, the dropping speed (collision speed) when the tension bar 55 drops on the medium M increases as the time necessary for dropping (that is, the drop distance) increases in a case of the same dropping start position.

Furthermore, since the loosening amount of the medium M increases as the amount of transport of the medium M increases, the drop distance of the tension bar 55 increases. Therefore, the drop distance varies depending on the dropping start position (inclination angle θ) and the amount of transport of the arms 54 at the time of starting the transport operation. Therefore, when dropping start position (inclination angle θ) of the tension bar 55 is located at the position that is equal to or higher than the predetermined height, excessive tensile force tends to be generated when the tension bar 55 drops on the medium M due to the long drop distance and the high dropping speed.

Thus, the relative speed between the tension bar 55 and the medium when the tension bar 55 drops on (collides against) the medium M is set to be equal to or less than a predetermined value by controlling the transport mechanism 23 and the winding unit 22 in the tensile force adjustment control according to the embodiment. Therefore, generation of excessive tensile force in the medium M is avoided when the tension bar 55 drops on the medium M.

Hereinafter, the tensile force adjustment control shown by the flowchart in FIG. 13 will be described with reference to FIGS. 9 to 12.

The control unit 41 obtains the amount of transport of the medium M to the next target stop position and obtains the target stop position from the amount of transport. The control unit 41 selects a speed profile in accordance with the amount of transport.

First, in Step S11, the control unit 41 causes the transport mechanism 23 to start the transport operation of transporting the medium M. That is, the control unit 41 starts the drive of the transport motor 23M. The control unit 41 controls acceleration of the transport motor 23M in accordance with an acceleration profile stored in the storage unit 45.

In Step S12, it is determined whether or not the amount of transport is greater than the tension bar drop allowable value. Here, the tension bar drop allowable value indicates the amount of transport obtained by adding a predetermined margin to the critical loosening amount by which there is a risk that the excessive tensile force is generated when the tension bar 55 collides against the medium M in a case in which only the transport mechanism 23 is driven in a state in which the winding unit 22 is stopped. In this example, table data indicating correspondence between the position of the tension bar 55 and the tension bar drop allowable value is stored in the storage unit 45. The control unit 41 obtains the tension bar drop allowable value in accordance with position information with reference to the table data that is read from the storage unit 45 based on the position information (inclination angle θ) of the tension bar 55. The control unit 41 may calculate the tension bar drop allowable value by using a predetermined calculation equation based on the position information of the tension bar 55. Another configuration can also be applied in which a constant tension bar drop allowable value is used regardless of the moving start position of the tension bar 55, by setting the tension bar drop allowable value in a case in which the tension bar 55 is located at the maximum position.

If the amount of transport is greater than the tension bar drop allowable value (positive in the determination in S12), the processing proceeds to Step S13. If the amount of transport is not greater than the tension bar drop allowable value (negative in the determination in S12), the routine is completed.

In Step S13, the control unit 41 executes winding speed control. That is, the control unit 41 controls the speed of the winding motor 22M that forms the winding unit 22 in accordance with the speed profile of the winding speed Vw shown by the graph in the lower section in FIG. 9 that is read from the storage unit 45.

As shown in FIG. 9, the control unit 41 sets the transport start timing of the winding unit 22 to be later than the transport start timing of the transport mechanism 23 by the predetermined delay time Δt and accelerates the winding unit 22 and the transport mechanism 23 with the same acceleration profile (degree of acceleration). As a result, the winding speed Vw (second transport speed) rises at timing when the transport speed Vf rises by the delay time Δt, and the winding speed Vw and the transport speed Vf are accelerated with the same speed gradient. Therefore, the winding speed Vw reaches the constant speed Vc at the timing later than the transport speed Vf by the delay time Δt.

Therefore, temporal changes in the loosening amount Sm of the medium M until this point are as shown in FIG. 9. That is, the loosening is formed in the delay time Δt after the transport of the medium M is started, and the loosening amount Sm increases. Then, the drive of the winding unit 22 is started after elapse of the delay time Δt. Since there is a slight difference in both the speeds Vf and Vw if the winding of the medium M around the roll body R2 is started, the loosening amount Sm slightly increases.

Then, both the transport speed Vf and the winding speed Vw are maintained at the constant speed Vc after the winding speed Vw reaches the constant speed Vc. Therefore, the medium M is maintained to have the constant loosening amount Sm. After the winding unit 22 starts the winding operation as described above, the transport mechanism 23 and the winding unit 22 transport the medium M in parallel. In the example, in particular, the control unit 41 controls the speeds of the transport mechanism 23 and the winding unit 22 with the same speed profile, and sets the transport speed Vf (first transport speed) in which the transport mechanism 23 transports the medium M to be the same as the winding speed Vw (second transport speed) in which the winding unit 22 transports the medium M. Therefore, since the tension bar 55 collides against the medium M after the winding speed Vw reaches the constant speed Vc although the loosening amount Sm formed in the initial period of the delay time Δt slightly increases in a period until the winding speed Vw reaches the constant speed Vc after the winding operation is started, it is possible to always maintain the loosening amount Sm of the medium M at the time of the collision to be substantially constant. As a result, it is possible to suppress variations in impact when the tension bar 55 cannot follow the loosening of the medium M at the time of starting the transport operation and collides against the medium M after being separated therefrom once to be small. Therefore, it is also possible to suppress the tensile force that is generated at the time of the collision to be small and further to suppress variations in the tensile force to be small.

If the medium M reaches the deceleration start position, then the transport speed Vf and the winding speed Vw start to be decelerated at the same timing, and the transport mechanism 23 and the winding unit 22 are decelerated with the same degree of deceleration in accordance with the same deceleration profile. Then, the transport mechanism 23 and the winding unit 22 stops the transport at the same stop timing.

Figure 10:
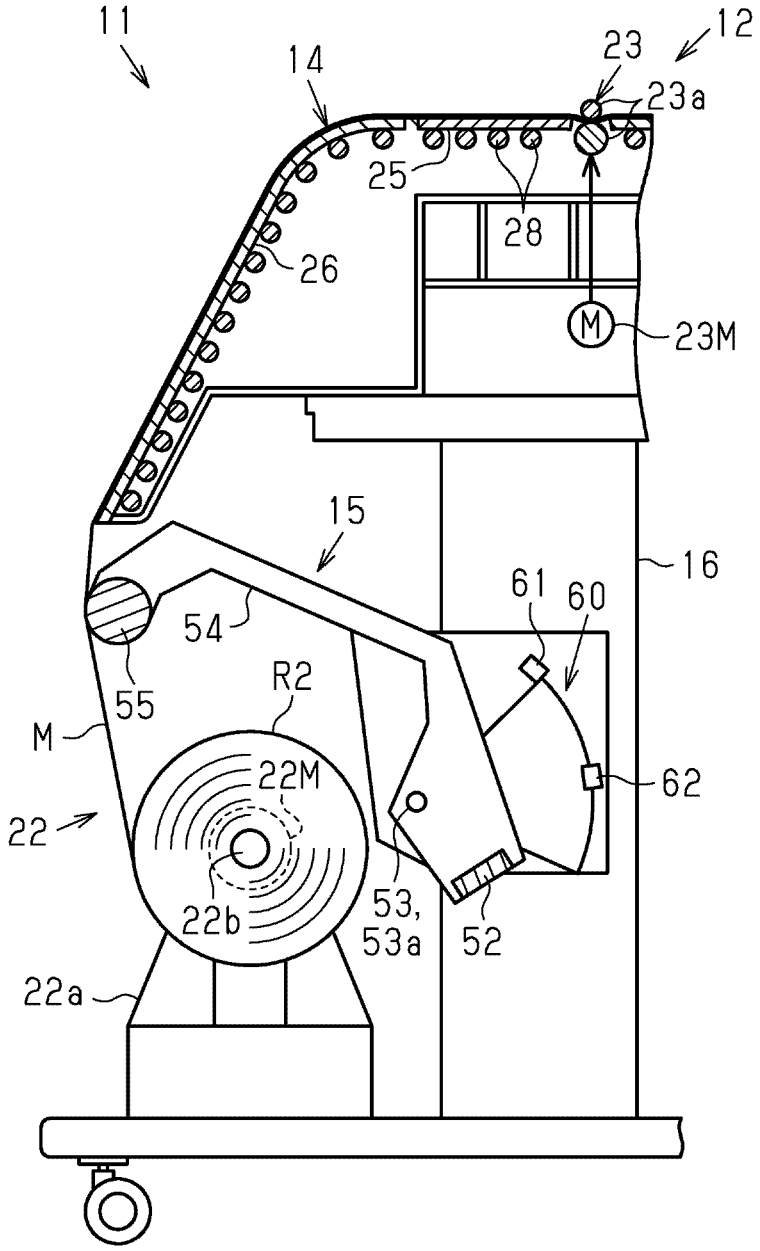
FIG. 10 is a side sectional view illustrating main parts of the printing apparatus before transport of the medium is started.
Figure 11:
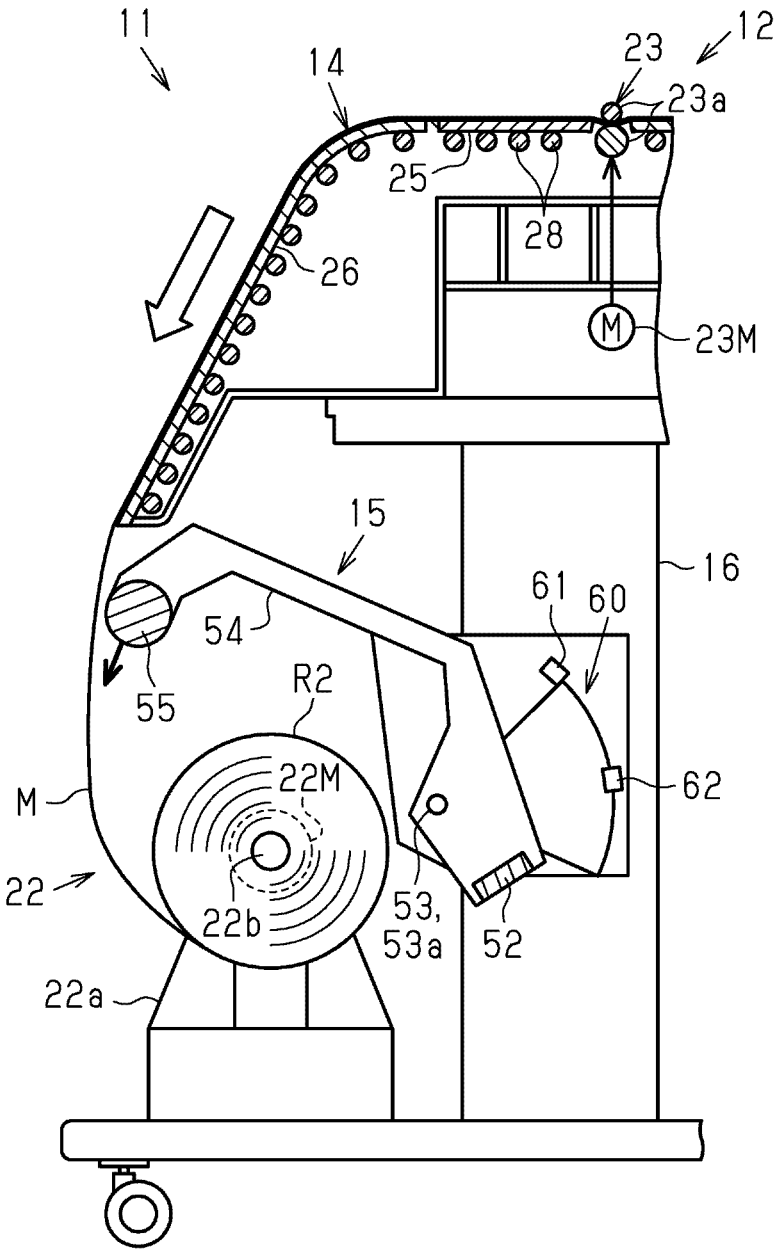
FIG. 11 is a side sectional view illustrating the main parts of the printing apparatus when the transport of the medium is started.

As shown in FIG. 10, the tension bar 55 is assumed to be located at the height that is equal to or higher than the predetermined position in a state in which both the transport mechanism 23 and the winding unit 22 are stopped before the transport is started and while no medium M is transported. In this case, the transport mechanism 23 is driven, and the transport of the medium M is started in the state in which the winding unit 22 is stopped as shown in FIG. 11. Then, the medium M is transported at the transport speed Vf represented by the one-dotted chain line in the graph in the lower section of FIG. 9, thereby generating loosening in the medium M at the portion between the end of the medium support unit 14 on the downstream side and the roll body R2 (see FIG. 11). At this time, the tension bar 55 with relatively large inertia relatively slowly starts to be lowered due to the weight of itself (bias force of itself), and the moving speed gradually increases with elapse of time. Therefore, the tension bar moving speed is lower than the loosening lowering speed of the medium M transported at the transport speed Vf when the transport of the medium M is started. As a result, the tension bar 55 cannot follow the loosening of the medium M and drops toward the medium M after being separated therefrom once.

Figure 12:
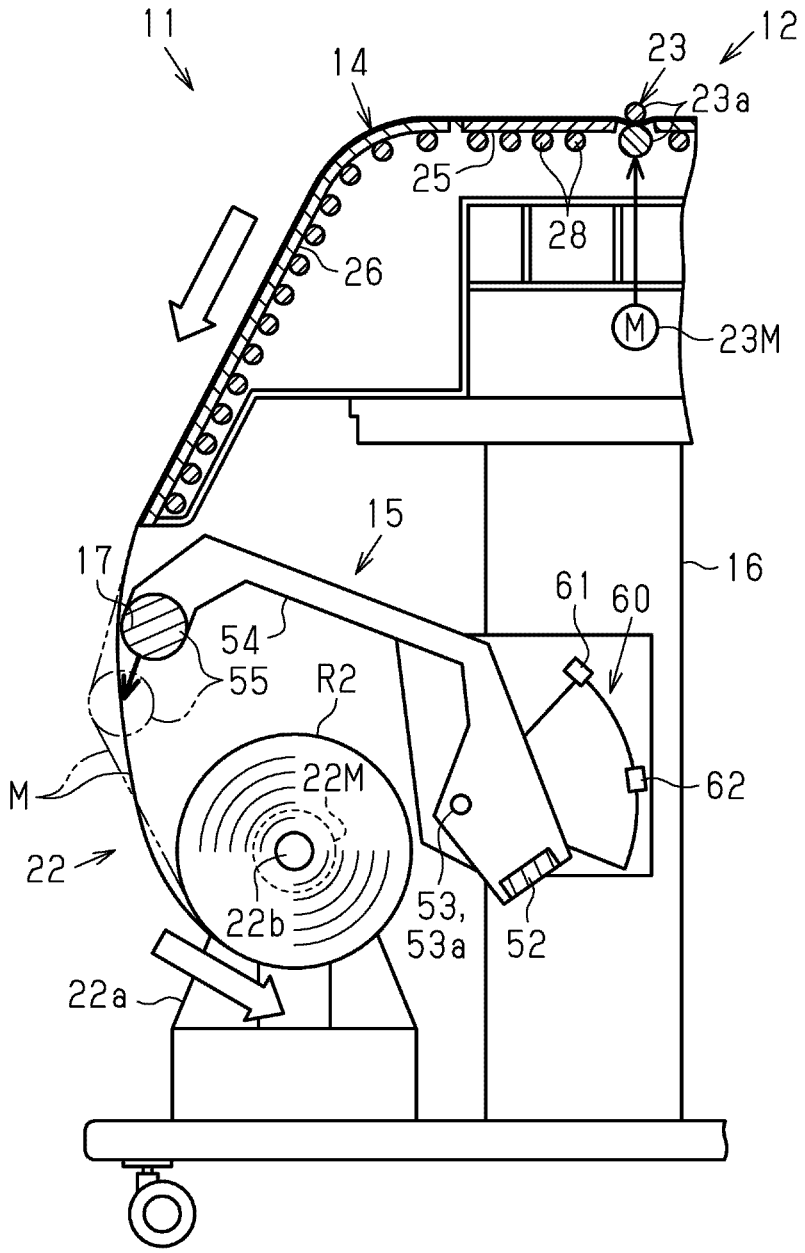
FIG. 12 is a side sectional view illustrating the main parts of the printing apparatus when the tensile force adjustment control is performed.

As shown in FIG. 12, the winding unit 22 starts the winding operation after the predetermined delay time Δt after the transport mechanism 23 starts the transport operation. Therefore, the transport of the medium M by the transport mechanism 23 and the winding of the medium M by the winding unit 22 are performed in parallel. At this time, while the loosening amount of the medium M slightly increases due to the slight difference in both the speed Vf and Vw until the winding speed Vw reaches the constant speed Vc, the loosening amount Sm of the medium M is suppressed to be relatively small as compared with a case in which the winding operation is not performed. Although the tension bar 55 drops (moves) to the drop position represented by the two-dotted chain line from the drop start position represented by the solid line in the drawing as shown in FIG. 12, the drop distance (moving distance) at this time is suppressed to be small. Although the tension bar 55 is gradually accelerated by the weight of itself (bias force), the drop distance until the tension bar 55 drops on the medium M is suppressed to be relatively small, the moving speed of the tension bar 55 when dropping on the medium M is suppressed to be relatively small.

Therefore, the relative speed between the tension bar 55 and the medium M becomes relatively low. Then, the tension bar 55 collides against the medium M in a state in which the relative speed is lower than the predetermined value. Therefore, it is possible to suppress impact energy between the tension bar 55 and the medium M to be small. As a result, it is possible to suppress generation of excessive tensile force in the medium M when the tension bar 55 collides against the medium M. The timing is adjusted such that the tension bar 55 collides against the medium M after both the transport speed Vf and the winding speed Vw reach the constant speed Vc. Therefore, variations in the loosening amount Sm when the tension bar 55 collides against the medium M are suppressed to be small, and this enables suppression of variations in the relative speed therebetween when the tension bar 55 collides against the medium M. As a result, it is possible to suppress variations in impact when the tension bar 55 collides against the medium M to be small.

Incidentally, there is a case in which there is a difference between a transport path length on a +X axis side (one end side) and a transport path length on a −X axis side (the other end side) in the width direction of the medium M in a transport path from the transport mechanism 23 to the winding unit 22 in assembly precision (error) of the printing apparatus 11. In a case in which the transport path length on the +X axis side is slightly shorter than the transport path length on the −X axis side, for example, loosening is generated in the medium M in the transport path on the +X axis side (the side of the short transport path length). In a case in which loosening is generated on the side of the short transport path length in the medium M, generation of high tensile force is biased toward the side of the long transport path length.

The winding unit 22 is driven, the medium M is wound around the roll body R2, and the tension bar 55 is wound and moved upward every time the transport mechanism 23 performs the transport operation a plurality of times and the tension bar 55 reaches an inclination angle J of the predetermined upper limit tensile force (broken line A) shown in FIG. 8. In the course of the winding, pulling force by the rotation drive of the winding unit 22 is applied in addition to the predetermined upper limit tensile force to the medium M. If the winding unit 22 is driven in a case in which there is a difference in the aforementioned transport path lengths at both end portions in the width direction at this time, the winding unit 22 causes such couple force that rotates the −X axis side (the other end side) of the long transport path length about the end (one end) on the +X axis side of the short transport path length. With the couple force, an obliquely extending tensile force focusing line, on which the tensile force is focused, is generated from the other end on the side of the long transport path length of the winding unit 22 toward the one end on the side of the short transport path length of the pair of transport rollers 23*a* in a rectangular region of the medium M at the portion between the pair of transport rollers 23*a* and the winding unit 22. With the tensile force focusing line, stronger pulling force toward the downstream side in the transport direction is generated in one end of the transport mechanism 23 in the width direction of the medium M.

It is assumed that relatively large bias force when the tension bar 55 drops is added in the state in which the tensile force focusing line has been generated. In such a case, a negative cycle in which the pulling force toward the downstream side in the transport direction becomes larger than frictional force between the medium M and the transport mechanism 23 on the one end side of the short transport path length, the medium M on the one end side, on which the medium M is loosened, slops toward the downstream side in the transport direction, and the loosening of the medium M further increases is repeated. There is a risk that accumulation of the loosening causes twist or wrinkle in the medium M to be wound by the winding unit 22 later.

Since the tensile force applying unit 15 according to the embodiment includes the counter weight 52, and the angle range (turning range) in which the tension bar 55 is made to swing can be further widened, it is possible to relatively reduce the number of windings of the tension bar 55 as compared with the tensile force applying unit in the comparative example in which no counter weight 52 is provided.

In contrast, since the tensile force applying unit 15 provided with the counter weight 52 has large inertia, and the tension bar 55 more slowly starts to move than the tensile force applying unit in the comparative example when the tension bar 55 drops by the weight of itself, there is a concern that the drop distance of the tension bar 55 and the collision speed of the tension bar 55 against the medium M become relatively large. However, the winding unit 22 is controlled such that the drop distance of the tension bar 55 and the relative speed between the tension bar 55 and the medium M become small when the dropping tension bar 55 collides against the medium M in the embodiment. Therefore, it is possible to suppress the tensile force generated in the medium M when the tension bar 55 drops on (collides against) the medium M to be small as compared with a configuration in which the winding operation is not performed during the transport operation. Therefore, it is possible to effectively suppress a situation in which the loosening of the medium M further increases on one end side (the side of the short transport path length) on which the medium M is loosened due to the impact of the drop of the tension bar 55. As a result, precision in the transport position of the medium M by the transport mechanism 23 increases, and precision in the print position by the printing unit 13 also increases accordingly. Therefore, it is possible to improve printing quality on the medium M wound as the roll body R2 and to further effectively suppress generation of twist and wrinkle in the medium M to be wound by the winding unit 22.

According to the aforementioned embodiment, the following effects can be obtained.

(1) The transport device 12 includes the transport mechanism 23 as an example of the first transport unit, the winding unit 22 as an example of the second transport unit, and the tensile force applying unit 15 that has the tension bar 55 that is biased toward the medium M at the portion between the transport mechanism 23 and the winding unit 22 and is provided as an example of the tensile force applying member for applying tensile force to the medium M. Furthermore, the transport device 12 includes the control unit 41 that independently and intermittently drives the transport mechanism 23 and the winding unit 22. The transport start timing of the winding unit 22 takes place later than the transport start timing of the transport mechanism 23, and the transport mechanism 23 and the winding unit 22 transport the medium M in parallel. Therefore, loosening is generated in the medium M at the portion between the transport mechanism 23 and the winding unit 22 due to the delay of the transport start timing of the winding unit 22 with respect to the transport start timing of the transport mechanism 23. Thereafter, the transport mechanism 23 and the winding unit 22 transport the medium M in parallel. Thereafter, the loosening amount of the medium M does not greatly vary. The loosening amount at this time is sufficiently smaller than the loosening amount of the medium M when the winding unit 22 is not driven and only the transport mechanism 23 is driven. Therefore, the moving distance (drop distance) until the tension bar 55 collides against the medium M since the tension bar 55 starts to move (drop, for example) by the bias force (weight, for example) of itself becomes relatively short. Since the tension bar 55 is gradually accelerated by the bias force of itself while moving by the moving distance, the moving speed when the tension bar 55 collides against the medium M decreases as the moving distance decreases. Therefore, impact (collision energy) is alleviated when the tension bar 55 cannot follow the loosening of the medium M and collides against the medium again after being separated therefrom once. Therefore, it is possible to suppress variations in the tensile force of the medium M at the portion between the transport mechanism 23 and the winding unit 22 to be small. For example, it is possible to suppress a frequency of generation of at least one of transport deviation and winding deviation, that is, conditions in which the medium M slips relative to at least one of the transport mechanism 23 and the winding unit 22 due to generation of excessive tensile force in the medium M to be small.

As a result, it is possible to maintain transport accuracy of the medium M by the transport mechanism 23 to be constant and to perform printing on the medium M with high precision and high image quality. In the state in which the tensile force focusing line is generated so as to obliquely extend by the difference between the transport path lengths at both ends in the width direction and drive force of the winding unit 22 with respect to the medium M at the portion between the transport mechanism 23 and the winding unit 22, excessive tensile force when the tension bar 55 collides against the medium M is suppressed. Therefore, it is possible to suppress the negative cycle in which the loosening of the medium M further increases on the side of the long transport path length from among both ends in the width direction of the medium M due to such excessive tensile force. Therefore, it is possible to reduce twist or wrinkle in the medium M to be wound by the winding unit 22 due to such an increase in the loosening of the medium M.

(2) The control unit 41 sets the transport speed Vf (an example of the first transport speed) in which the transport mechanism 23 transports the medium M to be the same as the winding speed Vw (an example of the second transport speed) in which the winding unit 22 transports the medium M. Therefore, it is possible to maintain the loosening amount Sm to be substantially constant after the transport speed Vf and the winding speed Vw reach the constant speed Vc (transport speed). Therefore, the loosening amount of the medium M when the tension bar 55 collides against the medium M is maintained to be substantially constant and sufficiently smaller than the loosening amount when the winding unit 22 is not driven. Therefore, it is possible to alleviate impact (collision energy) when the tension bar 55 collides against the medium M and to suppress variations in the impact to be small.

(3) In a case in which the amount of transport Lf (an example of the first transport distance) is equal to or greater than the tension bar drop allowable value Lo (an example of the predetermined distance), the control unit 41 sets the transport start timing of the winding unit 22 to be later than the transport start timing of the transport mechanism 23. In a case in which the amount of transport Lf is less than the tension bar drop allowable value Lo, the winding unit 22 is not driven. Therefore, it is possible to reduce the frequency at which the medium M deviates at the transport mechanism 23 by the medium M being pulled at the portion between the transport mechanism 23 and the winding unit 22 when the winding unit 22 is driven.

(4) The transport stop timing of the transport mechanism 23 is that of the winding unit 22. Therefore, loosening of the medium M does not increase or decrease after stopping the transport. For example, it is possible to suppress variations in tensile force due to an increase or decrease in loosening of the medium M in a state in which the tension bar 55 is pressurized.

(5) The tensile force applying unit 15 includes the counter weight 52 as an example of the tensile force reducing unit for reducing bias force of the tensile bar 55 on the medium M. Therefore, the tension bar 55 more slowly starts to move toward the biased direction as compared with the configuration in which no counter weight 52 is not provided when the medium M is transported and is loosened. Therefore, although the condition in which the tension bar 55 cannot follow the loosening of the medium M at the time of starting the transport and the tension bar 55 collides against the medium M after being separated therefrom once tends to occur, it is possible to suppress generation of excessive tensile force in the medium M when the tension bar 55 collides against the medium M by the control unit 41 controlling the transport mechanism 23 and the winding unit 22.

(6) The printing apparatus 11 includes the transport device 12 and the printing unit 13 that performs printing on the medium M that has been transported by the transport device 12. Therefore, it is possible to obtain the same effects as those of the transport device 12 by the printing apparatus 11. Therefore, it is possible to provide a printed material with high quality.

Second Embodiment

Next, a second embodiment will be described with reference to drawings. The second embodiment is the same as the first embodiment other than that the content of the tensile force adjustment control is different. Hereinafter, the content of control different from that in the first embodiment will be mainly described.

A control unit 41 controls a transport mechanism 23 as an example of the first transport unit and a winding unit 22 as an example of the second transport unit in the same manner as in the first embodiment. In the embodiment, the control unit 41 controls a transport speed Vf (one example of the first transport speed) of a medium M by the transport mechanism 23 and a winding speed Vw (one example of the second transport speed) of the medium M by the winding unit 22 by controlling speeds of a transport motor 23M and a winding motor 22M in accordance with an acceleration/deceleration profile represented by the graph in the lower section in FIG. 14.

Figure 14:
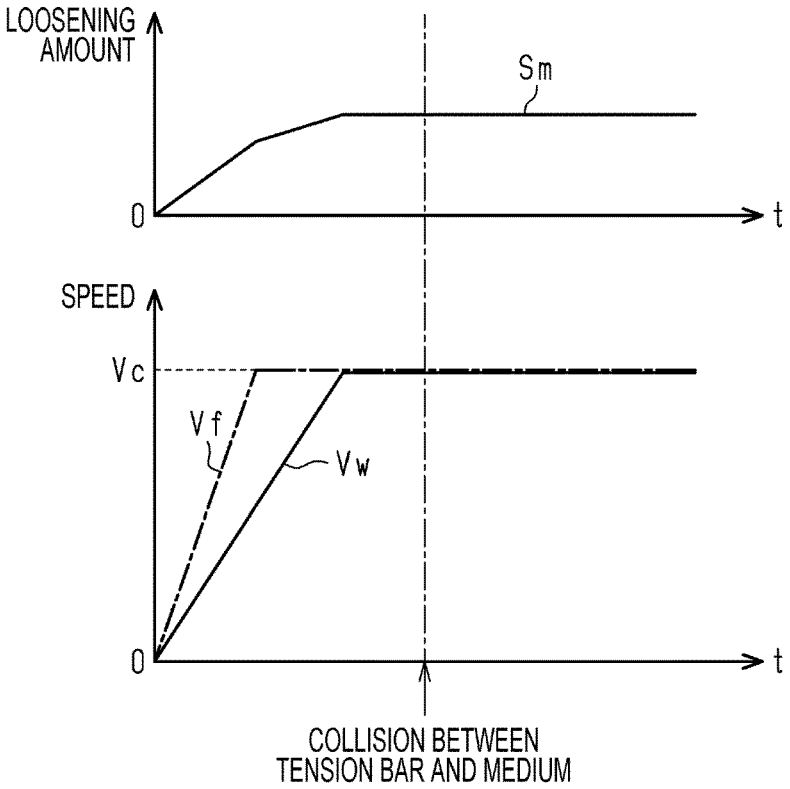
FIG. 14 is a graph illustrating temporal changes in a transport speed, a winding speed, and a loosening amount in tensile force adjustment control according to a second embodiment.

As shown by the graph in the lower section in FIG. 14, the transport start timing of the transport mechanism 23 and the transport start timing of the winding unit 22 controlled by the control unit 41 are the same. The drive at the transport speed Vf and the winding speed Vw starts at same time. Then, the winding speed Vw in which the winding unit 22 transports the medium M is set to be lower than the transport speed Vf in which the transport mechanism 23 transports the medium M at least in the process of acceleration. In the example, a speed gradient (degree of acceleration) as a temporal change of the winding speed Vw is set to be smaller than a speed gradient (degree of acceleration) as a temporal change of the transport speed Vf in the process of acceleration as shown in FIG. 14. In the example shown in FIG. 14, the winding speed Vw of the winding unit 22 is set to be the same as the transport speed Vf of the transport mechanism 23 in a constant speed range. The winding speed Vw may be set to be lower than the transport speed Vf even in the constant speed range.

When the transport mechanism 23 performs transport by a predetermined length, the winding unit 22 starts to perform transport at the same time as the transport mechanism 23, and the control unit 41 drives the transport mechanism 23 and the winding unit 22 such that the winding speed is lower than the transport speed Vf of the transport mechanism 23. Since the winding speed Vw of the winding unit 22 is lower than the transport speed Vf of the transport mechanism 23 in the process of acceleration, the loosening amount of the medium M gradually increases from the time of starting the transport as shown by the graph in the upper section in FIG. 14. Then, if the winding speed Vw of the winding unit 22 reaches the constant speed Vc, and the process of acceleration is changed to the process of the constant speed, then the transport speed Vf and the winding speed Vw are maintained at the same constant speed Vc. Therefore, the loosening of the medium M is maintained at a substantially constant loosening amount Sm in the process of the constant speed. The loosening amount Sm of the medium M at this time is sufficiently small as compared to a case in which the winding unit 22 is not driven.

Therefore, the loosening amount Sm of the medium M when the tension bar 55 collides against the loosened medium M after a moment after the start of the transport can be substantially constantly maintained at a small amount. Therefore, it is possible to suppress the magnitude and variations in impact when the tension bar 55 cannot follow the loosening of the medium M at the time of starting the transport operation and collides against the medium M after being separated therefrom once to be small. As a result, it is possible to suppress the tensile force of the medium M that is generated at the time of the collision and to further suppress variations in the tensile force.

If the medium M being transported reaches a deceleration start position before a target position, then the transport mechanism 23 and the winding unit 22 start to decelerate at the same timing, the transport speed Vf and the winding speed Vw gradually decrease with the same degree of deceleration, and the transport mechanism 23 and the winding unit 22 stop the transport operation of the medium M and the winding operation of the medium M at the same transport stop timing.

According to the second embodiment, the same effects as those of the first embodiment are obtained, and also, the loosening amount Sm at the time of the start of the transport more gradually increases as compared with the first embodiment since the transport operation of the transport mechanism 23 and the winding operation of the winding unit 22 are started at the same timing and the winding speed Vw is lower than the transport speed Vf.

According to the second embodiment, the following effect can be obtained as described above in detail.

(7) The transport start timing of the transport mechanism 23 is the same as that of the winding unit 22, and the winding speed Vw in which the winding unit 22 transports the medium M is lower than the transport speed Vf in which the transport mechanism 23 transports the medium M. Therefore, loosening is formed in the medium M at the portion between the transport mechanism 23 and the winding unit 22, and the loosening amount Sm of the medium M at this time becomes smaller than that in the case in which the winding unit 22 is not driven. Therefore, the drop distance (moving distance) until the tension bar 55 collides against the medium M after being separated therefrom once since the tension bar 55 starts to move becomes relatively short. As a result, it is possible to alleviate the impact when the tension bar 55 collides against the medium M.

Third Embodiment

Next, a third embodiment will be described with reference to drawings. The third embodiment is the same as the first embodiment other than that content of the tensile force adjustment control is different. Hereinafter, the content of control different from that in the first embodiment will be mainly described.

A control unit 41 controls a transport mechanism 23 as an example of the first transport unit and a winding unit 22 as an example of the second transport unit in the same manner as in the first embodiment. In the embodiment, the control unit 41 controls a transport speed Vf (an example of the first transport speed) of a medium M by the transport mechanism 23 and a winding speed Vw (an example of the second transport speed) of the medium M by the winding unit 22 by controlling the speeds of a transport motor 23M and a winding motor 22M in accordance with the acceleration/deceleration profile represented by the graph in the lower section in FIG. 15.

As shown by the graph in the lower section in FIG. 15, the transport start timing of the winding unit 22 takes place later than the transport start timing of the transport mechanism 23 by a delay time Δt, and the transport mechanism 23 and the winding unit 22 transport the medium M in parallel. In the example, in particular, the control unit 41 sets a degree of acceleration (acceleration profile) in an acceleration process when the transport mechanism 23 transports the medium M and a degree of acceleration in an acceleration process in which the winding unit 22 transports the medium M to be the same as those in the first embodiment and sets the second transport speed Vw to be lower than the first transport speed Vf in a constant speed range (Vw<Vf).

In a case in which an amount of transport Lf by which the transport mechanism 23 transports the medium M is equal to or greater than a tension bar drop allowable value, the control unit 41 executes tensile force adjustment control. In a case in which the amount of transport Lf is less than the tension bar drop allowable value Lo, the control unit 41 does not execute the tensile force adjustment control and does not drive the winding unit 22. The transport stop timing of the transport mechanism 23 is set to be the same as that of the winding unit 22 in the same manner as in the first embodiment.

Figure 15:
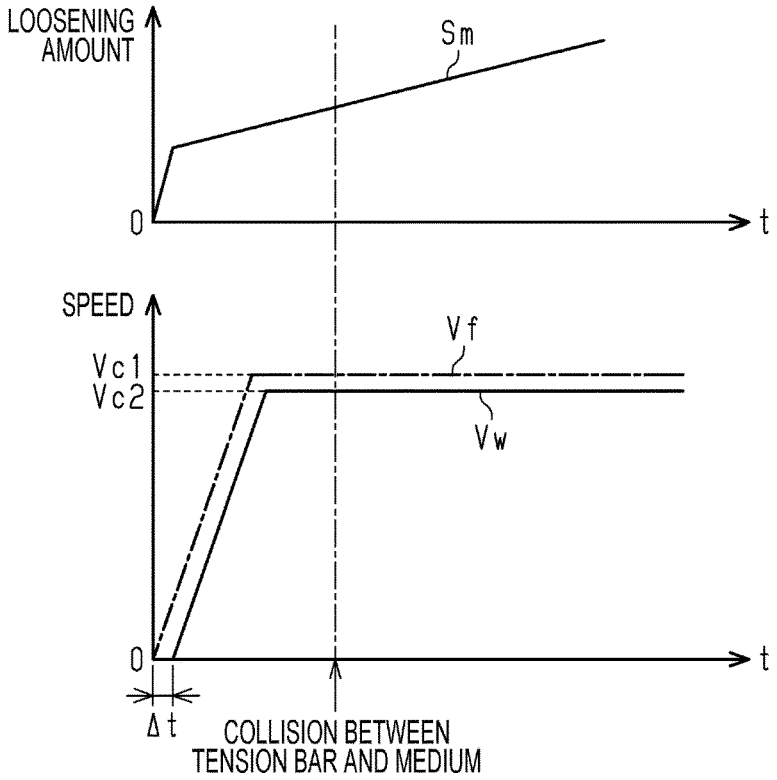
FIG. 15 is a graph illustrating temporal changes in a transport speed, a winding speed, and a loosening amount in tensile force adjustment control according to a third embodiment.

In the case in which the amount of transport Lf of the transport mechanism 23 is equal to or greater than the tension bar drop allowable value Lo, the control unit 41 starts the winding operation with a delay of the constant delay time Δt after the start of the transport operation as shown in the lower section in FIG. 15. Therefore, a loosening amount Sm increases immediately after the start of the transport of the medium M. Thereafter, since the winding speed Vw is slightly lower than the transport speed Vf due to the difference in the transport start timing although the transport mechanism 23 and the winding unit 22 are driven by the same acceleration profile, the loosening amount Sm gradually increases in the acceleration process of the winding unit 22. Furthermore, the control unit 41 manages the winding speed Vw to be slightly lower than the transport speed Vf in the constant speed process. Therefore, the loosening amount Sm gradually increases even after the transport speed Vf and the winding speed Vw become the constant speeds Vc1 and Vc2, respectively. Then, since the loosening amount Sm when the tension bar 55 collides against the medium M is sufficiently smaller than that in a case in which the winding unit 22 is not driven, the impact at that time is alleviated to be small. As a result, generation of excessive tensile force in the medium M is avoided, and deviation in the transport of the medium M by the transport mechanism 23 and deviation in the winding of the medium M by the winding unit 22 are thus suppressed.

According to the third embodiment, the following effect is obtained as described above in detail.

(8) In the case in which the amount of transport Lf (an example of the first transport distance) is equal to or greater than the predetermined distance, the control unit 41 sets the transport start timing of the winding unit 22 to be later than that of the transport mechanism 23. In the case in which the amount of transport Lf is less than the predetermined distance, the control unit 41 does not drive the winding unit 22. Therefore, it is possible to suppress the generation of the excessive tensile force in the medium M when the tension bar 55 collides against the medium M in the case in which the amount of transport Lf is equal to or greater than the predetermined distance. In contrast, it is possible to avoid the increase in the tensile force of the medium M due to pulling of the medium M at the portion between the transport mechanism 23 and the winding unit 22, which is caused by the winding unit 22 being driven, in a case in which the amount of transport Lf is less than the predetermined distance. Therefore, it is possible to reduce a frequency at which the medium M deviates at the transport mechanism 23 due to the increase in the tensile force of the medium M.

Fourth Embodiment

Next, a fourth embodiment will be described with reference to drawings. The fourth embodiment is the same as the aforementioned first embodiment other than that the content of the tensile force adjustment control is different. Hereinafter, the content of control that is different from that in the first embodiment will be mainly described.

A control unit 41 controls a transport mechanism 23 as an example of the first transport unit and a winding unit 22 as an example of the second transport unit in the same manner as in the first embodiment. In the embodiment, the control unit 41 controls the speeds of a transport motor 23M and a winding motor 22M in accordance with an acceleration/deceleration profile represented by the graph in the lower section in FIG. 16. In this manner, the control unit 41 controls a transport speed Vf (an example of the first transport speed) of a medium M by the transport mechanism 23 and a winding speed Vw (an example of the second transport speed) of the medium M by the winding unit 22.

Even in the embodiment, in a case in which an amount of transport Lf by which the transport mechanism 23 transports the medium M is equal to or greater than a tension bar drop allowable value Lo, the control unit 41 executes tensile force adjustment control. In a case in which the amount of transport Lf is less than the tension bar drop allowable value Lo, the control unit 41 does not execute the tensile force adjustment control (that is, the control unit 41 does not drive the winding unit 22). Also, the transport stop timing of the transport mechanism 23 is set to be the same as that of the winding unit 22 in the same manner as in the first embodiment.

As shown by the graph in the lower section in FIG. 16, in the case in which the transport amount Lf by which the transport mechanism 23 transports the medium M is equal to or greater than the tension bar drop allowable value Lo, the transport start timing of the winding unit 22 takes place later than the transport start timing of the transport mechanism 23 by a delay time Δt, and the transport mechanism 23 and the winding unit 22 transport the medium M in parallel after the start of the winding operation. At this time, a loosening amount Sm increases immediately after the start of the transport of the medium M as shown by the graph in the upper section in FIG. 16. Thereafter, since the winding speed Vw is slightly lower than the transport speed Vf due to the difference in the transport start timing although the transport mechanism 23 and the winding unit 22 are driven by the same acceleration profile, the loosening amount Sm gently increases in the acceleration process of the winding unit 22.

Figure 16:
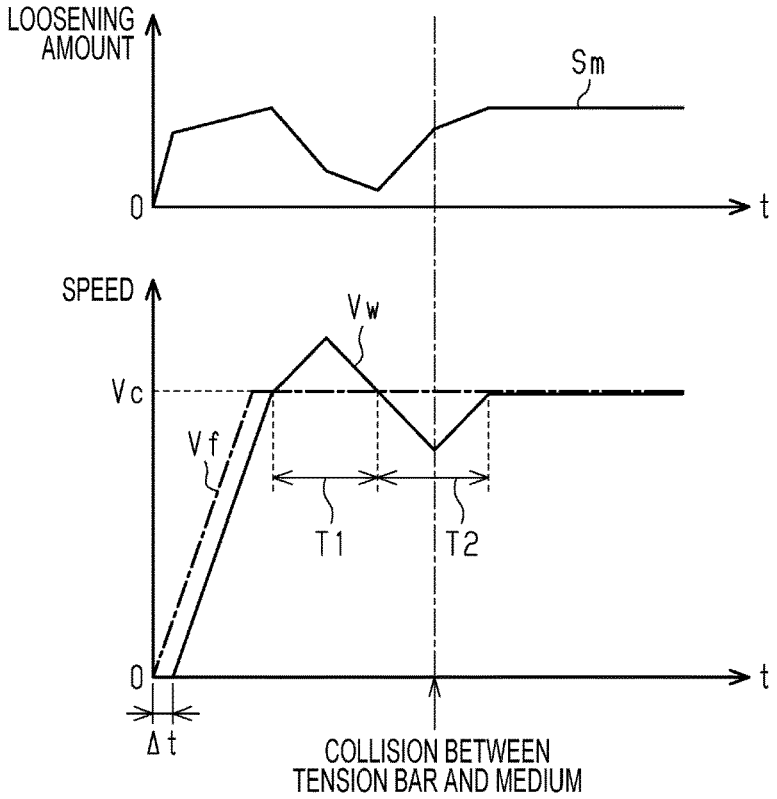
FIG. 16 is a graph illustrating temporal changes in a transport speed, a winding speed, and a loosening amount in tensile force adjustment control according to a fourth embodiment.

In the example, there is a period T1 (first period) during which the winding speed Vw of the winding unit 22 is higher than the transport speed Vf of the transport mechanism 23 as shown by the graph in the lower section in FIG. 16. The loosening amount Sm decreases in the first period T1. The control unit 41 sets the amount of transport (an example of the first transport distance) by which the transport mechanism 23 transports the medium M until the first period T1 ends to be longer than the amount of winding (an example of the second transport distance) by which the winding unit 22 transports (winds) the medium M until the first period T1 ends. Therefore, there is at least no case in which no loosening is included in the medium M even if the loosening amount Sm decreases in the medium M in the period T1 during which the winding speed Vw is higher than the transport speed Vf. The medium M relatively approaches the tension bar 55 due to the decrease in the loosening amount Sm, and the drop distance until the tension bar 55 drops on the medium M becomes relatively short.

As shown by the graph in the lower section in FIG. 16, the control unit 41 according to the embodiment has a period T2 (second period) during which the winding speed Vw is lower than the transport speed Vf after the first period T1. Therefore, the loosening amount Sm of the medium M increases in the second period T2. Then, the tension bar 55 collides against the medium M in the process in which the loosening amount Sm increases. Since the medium M moves away from the tension bar 55 in the process in which the loosening amount Sm of the medium M increases, the relative speed between the tension bar 55 and the medium M decreases. Therefore, since the tension bar 55 collides against the medium M in a state in which the relative speed with the medium M is low, impact received by the medium M at the time of the collision is further alleviated to be small. Since the medium M has approached the tension bar 55 in the first period T1, the loosening amount Sm of the medium M when the tension bar 55 collides against the medium M is sufficiently small even if the medium M is moved away from the tension bar 55 in the second period T2. Therefore, the drop distance until the tension bar 55 drops on the medium M from the drop start position is suppressed to be sufficiently small, and this point effectively works for further alleviating the impact when the tension bar 55 collides against the medium M.

Another configuration can also be applied in which the winding speed Vw and the transport speed Vf are maintained at the same speed after the period T1 during which the winding speed Vw is higher than the transport speed Vf such that the tension bar 55 drops on the medium M in the state in which the transport speed Vf and the winding speed Vw are the same speed. Even with the configuration, it is possible to effectively suppress the drop distance of the tension bar 55 to be small and to further suppress the relative speed therebetween to be small as compared with the case in which the tension bar 55 collides against the approaching medium M. The winding operation of the winding unit 22 may be started at the same time with the transport operation of the transport mechanism 23 (delay time Δt=0), and the winding speed Vw may be set to be lower than the transport speed Vf, thereby forming the loosening in the medium M in the same manner as in the second embodiment (FIG. 14).

According to the fourth embodiment, the following effects are obtained as described above in detail.

(9) The control unit 41 has the period T1 during which the winding speed Vw is set to be higher than the transport speed Vf after loosening is formed in the medium M in the initial stage after starting the transport, and sets the first transport distance by which the transport mechanism 23 transports the medium M until the period T1 ends to be longer than the second transport distance by which the winding unit 22 winds the medium M until the period T1 ends. Therefore, it is possible to relatively shorten the moving distance (drop distance) until the tension bar 55 is brought into contact with the medium M after the tension bar 55 starts to move by the bias (weight) of itself and to alleviate impact when the tension bar 55 collides against the medium M.

(10) Furthermore, the winding speed Vw is set to be lower than the transport speed Vf in the second period T2 after the first period T1. Therefore, it is possible to shorten the moving distance (drop distance) until the tension bar 55 is brought into contact with the medium M by reducing the loosening amount Sm of the medium M, which is formed in the initial stage of the start of the transport of the medium M, and further to reduce the relative speed therebetween when the tension bar 55 collides against the medium M in the second period T2 thereafter. As a result, it is possible to further suppress the impact when the tension bar 55 collides against the medium M to be small and to further suppress tensile force generated in the medium M to be small at this time.

Fifth Embodiment

Next, a fifth embodiment will be described with reference to drawings. The fifth embodiment is the same as the first embodiment other than that content of tensile force adjustment control is different. Hereinafter, the content of control that is different from that in the first embodiment will be mainly described.

A control unit 41 controls a transport mechanism 23 as an example of the first transport unit and a winding unit as an example of the second transport unit in the same manner as in the first embodiment. In the embodiment, the control unit 41 controls a transport speed Vf (an example of the first transport speed) of a medium M by the transport mechanism 23 and a winding speed Vw (an example of the second transport speed) of the medium M by the winding unit 22 in accordance with the same acceleration/deceleration profile as that in the first embodiment. However, the control unit 41 controls the speed of the winding unit 22 such that the winding speed Vw of the winding unit 22 follows variations in the transport speed Vf in a case in which the transport speed Vf of the transport mechanism 23 varies in the embodiment.

In a case in which an amount of transport Lf by which the transport mechanism 23 transports the medium M is equal to or greater than a tension bar drop allowable value Lo, the control unit 41 executes tensile force adjustment control. In a case in which the amount of transport Lf is less than the tension bar drop allowable value Lo, the control unit 41 does not execute the tensile force adjustment control and does not drive the winding unit 22. The transport stop timing of the transport mechanism 23 is set to be the same as the transport stop timing of the winding unit 22 in the same manner as in the first embodiment.

Figure 17:
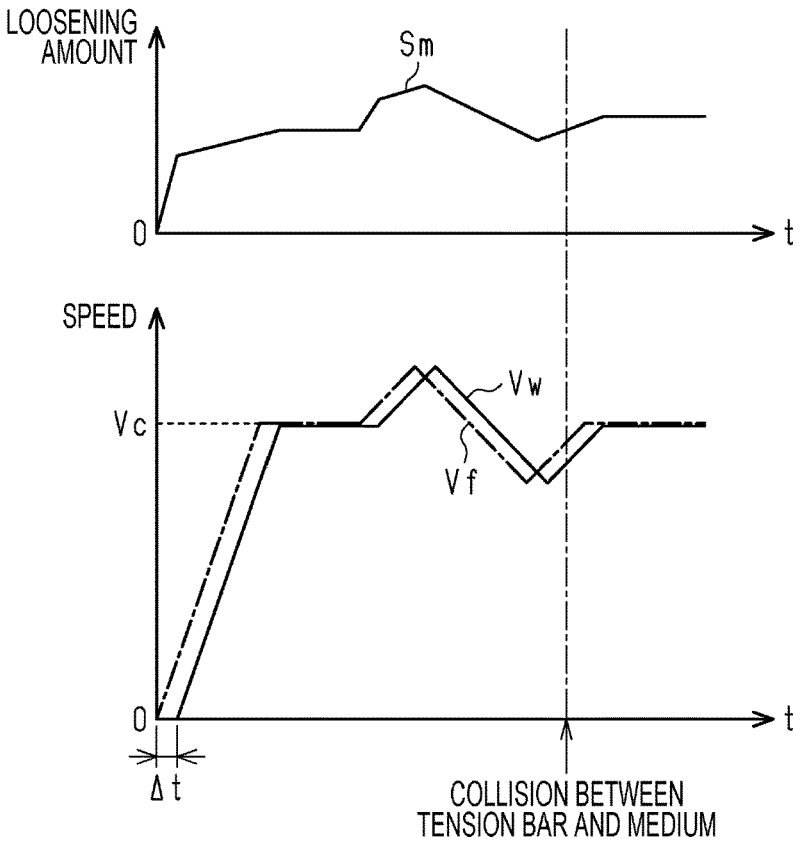
FIG. 17 is a graph illustrating temporal changes in a transport speed, a winding speed, and a loosening amount in tensile force adjustment control according to a fifth embodiment.

As shown in FIG. 17, in the case in which the amount of transport Lf is equal to or greater than the tension bar drop allowable value Lo, the transport start timing of the winding unit 22 takes place later than the transport start timing of the transport mechanism 23 by a delay time Δt, and the transport mechanism 23 and the winding unit 22 transport the medium M in parallel after the start of the winding operation. Since the loosening amount Sm increases immediately after the start of the transport of the medium M and the winding speed Vw is then slightly lower than the transport speed Vf due to the difference in the transport start timing in the acceleration process as shown by the graph in the upper section in FIG. 17, the loosening amount Sm gently increases. Since the transport speed Vf and the winding speed Vw become the same constant speed Vc in a constant speed range, the loosening amount Sm is basically maintained to be substantially constant.

In the example, the control unit 41 controls the speed of the winding unit 22 such that the winding speed Vw of the winding unit 22 follows variations in the transport speed Vf in a case in which the transport speed Vf of the transport mechanism 23 varies for some reasons in the constant speed range, for example, as shown by the graph in the lower section in FIG. 17. More specifically, if the transport speed Vf (actual transport speed) based on a rotation detection signal from a first rotation detector 48 deviates from a target transport speed based on an acceleration/deceleration profile, the control unit 41 controls the speed of the transport mechanism 23 such that the transport speed Vf approaches the target transport speed. Furthermore, the control unit 41 controls the speed of the winding unit 22 toward a side on which the variations in the difference of the speed due to the deviation in the transport speed Vf at this time is reduced, in the difference between the winding speed Vw (actual winding speed) and the transport speed Vf based on a rotation detection signal from a second rotation detector 49.

As a result, it is possible to suppress the amount of variations in the loosing amount Sm at this time to be small by the winding speed Vw following the transport speed Vf even if the loosening amount Sm varies due to the variations in the transport speed Vf. As shown by the graph in the lower section in FIG. 17, for example, it is possible to suppress the variations in the loosening amount Sm of the medium M due to the variations in the transport speed Vf to be relatively small by the winding speed Vw following the varying transport speed Vf even if the transport speed Vf varies in the constant speed range.

Therefore, it is possible to suppress the loosening amount Sm of the medium M when the tension bar 55 collides against the medium M even if the transport speed Vf varies before the tension bar 55 collides against the medium M after the start of the transport of the medium M within a smaller range of the amount of variations, as compared with the loosening amount Sm in a case in which the transport speed Vf does not vary. As a result, it is possible to suppress the magnitude and variations in impact when the tension bar 55 collides against the medium M to be small considering the variations in the transport speed Vf. Therefore, it is possible to avoid generation of excessive tensile force in the medium M and further to suppress variations in the tensile force to be small. Another configuration can also be applied in which the winding operation of the winding unit 22 starts at the same time with the transport operation of the transport mechanism 23. Although the transport speed Vf (first transport speed) and the winding speed Vw (second transport speed) are the same in the constant speed range, the winding speed Vw may be lower than the transport speed Vf, or there may be a period T1 (see FIG. 16) during which the winding speed Vw is higher than the transport speed Vf.

According to the fifth embodiment, the following effect are obtained as described above in detail.

(11) The control unit 41 controls the winding speed Vw so as to follow the variations in the transport speed Vf. Therefore, it is possible to suppress the variations in the loosening amount Sm when the tension bar 55 collides against the medium M even if the transport speed Vf varies. As a result, it is possible to suppress the loosening amount Sm when the tension bar 55 collides against the medium M to be relatively small and to further suppress the variations in the loosening amount Sm to be relatively small considering the variations in the transport speed Vf. Therefore, it is possible to suppress both excessive tensile force and variations in the tensile force generated in the medium M when the tension bar 55 collides against the medium M.

Sixth Embodiment

Next, a sixth embodiment will be described with reference to drawings. Although the speed of the winding motor 22M is controlled without taking the outer diameter of the winding around the roll body R2 into consideration in the first embodiment, a winding speed Vw of a winding unit 22 is controlled in accordance with the outer diameter of the winding around a roll body R2 in the embodiment. The sixth embodiment is the same as the first to fifth embodiments other than this different point. Hereinafter, the content of control different from that in the first embodiment will be mainly described.

A control unit 41 controls a transport mechanism 23 as an example of the first transport unit and the winding unit 22 as an example of the second transport unit in the same manner as in the first embodiment. A printing apparatus 11 according to the embodiment further has a measurement unit 50 represented by a two-dotted chain line in FIG. 6. The measurement unit 50 is for measuring the outer diameter of the winding around the roll body R2 and is formed of a sensor, for example. The measurement unit 50 inputs a detection signal including a detection value in accordance with the outer diameter of the winding around the roll body R2 to the control unit 41. The measurement unit 50 is formed of a non-contact sensor such as a distance sensor or an image sensor, for example or a contact sensor that is brought into contact with an outer circumferential surface of the roll body R2. A storage unit 45 stores a program for tensile force adjustment control showy by the flowchart in FIG. 18.

Hereinafter, the tensile force adjustment control performed by the control unit 41 will be described with reference to the flowchart shown in FIG. 18.

First, in Step S21, the control unit 41 measures the outer diameter of the winding by the measurement unit 50. For example, the measurement unit 50 inputs a detection signal including a detection value in accordance with the outer diameter of the winding around the roll body R2, which is measured by the measurement unit 50, to the control unit 41. The control unit 41 obtains the outer diameter of the winding around the roll body R2, which is measured by the measurement unit 50, based on the detection value in the detection signal from the measurement unit 50.

In the next Step S22, the control unit 41 starts a transport operation in which the transport mechanism 23 is made to transport the medium M. That is, the control unit 41 starts to drive a transport motor 23M. The control unit 41 controls acceleration of the transport motor 23M in accordance with an acceleration profile stored in the storage unit 45. As a result, the transport operation of the medium M by the transport mechanism 23 is started, and the medium M, on which a printing unit 13 has completed printing, is fed from the transport mechanism 23 to the downstream side in the transport direction.

In Step S23, the winding speed Vw is corrected based on the outer diameter of the winding. The control unit 41 obtains a correction value corresponding to the outer diameter of the winding at this time with reference to a correction table that represents a relationship between the outer diameter of the winding and the winding speed Vw stored in the storage unit 45. Furthermore, the control unit 41 corrects the speed set in an acceleration/deceleration profile by using the correction value. As a result, the winding speed Vw in accordance with the outer diameter of the winding is obtained.

In Step S24, the control unit 41 controls the winding speed. That is, the control unit 41 controls the drive of the winding motor 22M in accordance with the acceleration/deceleration profile after the correction. As a result, the winding unit 22 winds the medium M fed from the transport mechanism 23 at the winding speed Vw after the correction. A relationship between the transport start timing of the transport mechanism 23 and the transport start timing (winding start timing) of the winding unit 22, a magnitude relationship of temporal changes (degrees of acceleration) in the acceleration process of the transport speed Vf and the winding speed Vw, and a magnitude relationship between the transport speed Vf and the winding speed Vw are basically the same as the content of the setting represented by the timing charts in the first to fifth embodiments. In the embodiment, winding by the winding unit 22 is controlled at the winding speed Vw obtained after correcting the winding speed Vw set in accordance with the acceleration/deceleration profile in accordance with the outer diameter of the winding R around the roll body R2.

According to the sixth embodiment, the following effect is obtained as described above in detail.

(12) The control unit 41 obtains the outer diameter of the winding R by the winding unit 22 and corrects the winding speed Vw (an example of the second transport speed) of the winding unit 22 as an example of the second transport unit in accordance with the outer diameter of the winding R. Therefore, since the winding speed Vw when the winding unit 22 transports the medium M is corrected in accordance with the outer diameter of the winding R around the roll body R2, it is possible to appropriately alleviate impact when the tension bar 55 collides against the medium M, regardless of the outer diameter of the winding R around the roll body R2.

Seventh Embodiment

Next, a seventh embodiment will be described with reference to drawings. In the seventh embodiment, measurement processing for obtaining an outer diameter of the winding is performed without using the measurement unit 50 formed of the sensor or the like in the sixth embodiment. The seventh embodiment is the same as the first embodiment other than this different point. Hereinafter, the content of the control different from that in the sixth embodiment will be mainly described.

Figure 18:
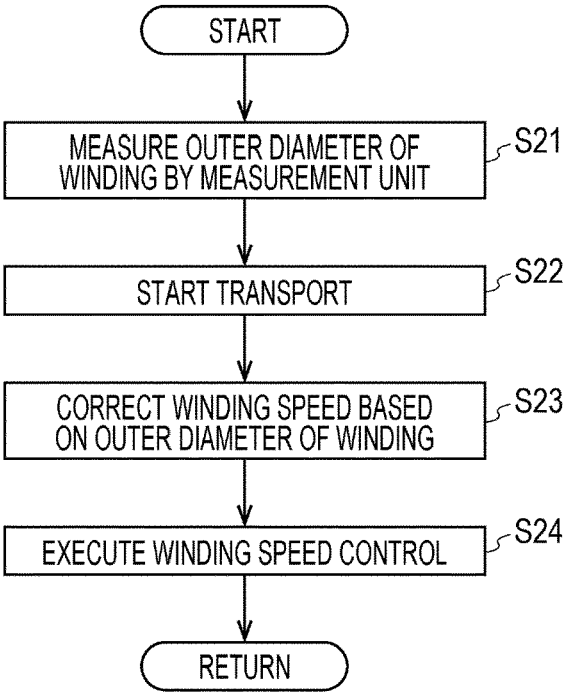
FIG. 18 is a flowchart illustrating tensile force adjustment control according to a sixth embodiment.
Figure 19:
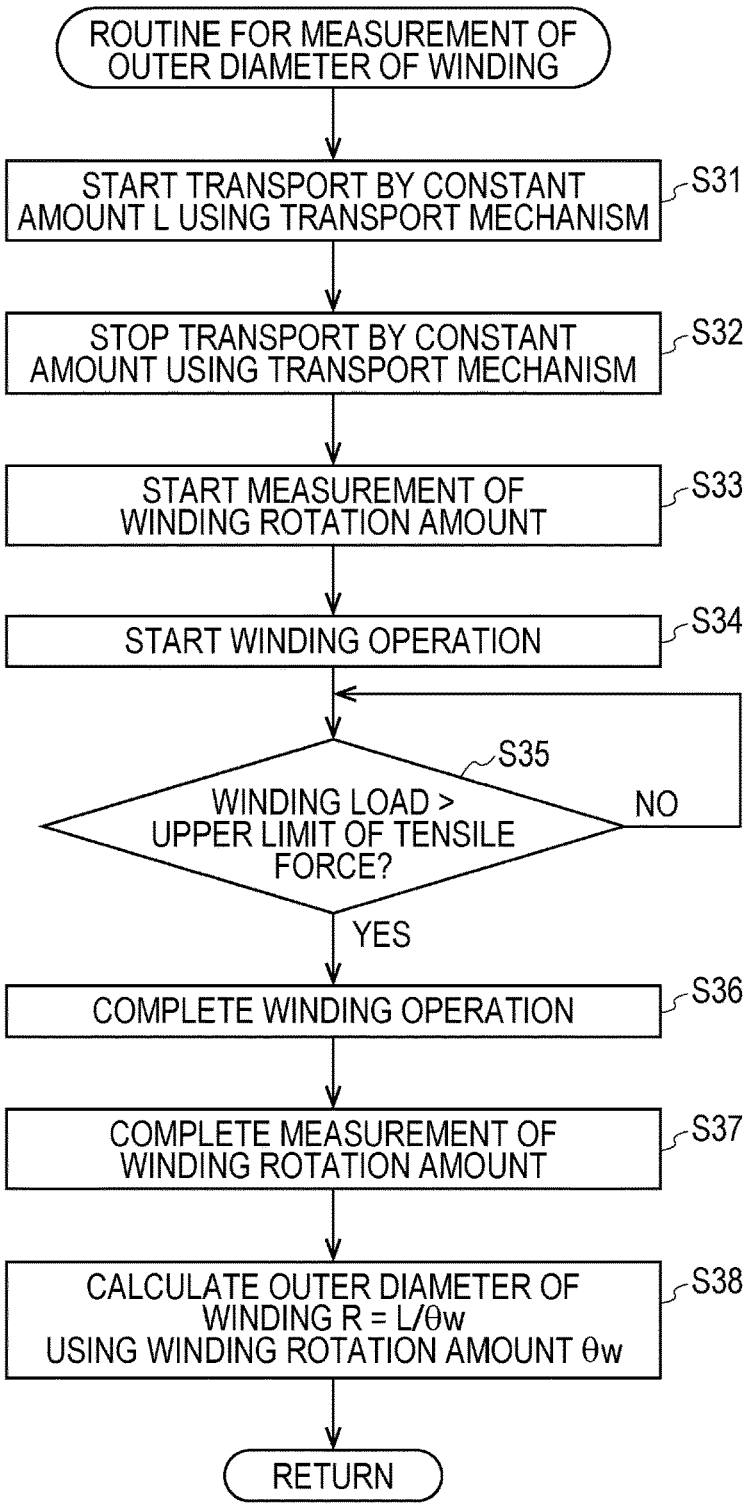
FIG. 19 is a flowchart illustrating tensile force adjustment control according to a seventh embodiment.

A storage unit 45 stores a program for a winding outer diameter measurement routine represented by the flowchart in FIG. 19. The storage unit 45 stores the same speed control profile as those in the first to fifth embodiments. Here, the measurement of the outer diameter of the winding (Step S21) performed by the measurement unit 50 in the tensile force adjustment control shown in FIG. 18 in the fifth embodiment is performed by software processing using the respective detection signals of a first rotation detector 48 and a second rotation detector 49 in a transport system by executing the winding outer diameter measurement routine shown in FIG. 19 without using the measurement unit 50.

A control unit 41 executes the winding outer diameter measurement routine shown in FIG. 19 when the transport operation is not performed. The control unit 41 executes the winding outer diameter measurement routine when the power of a printing apparatus 11 is turned on, when printing is waited, or when the transport operation is performed during printing, for example.

First, in Step S31, a transport mechanism 23 starts transport by a constant amount L. That is, the control unit 41 drives the transport mechanism 23 in a state in which the drive of the winding unit 22 is stopped. The control unit 41 counts the number of pulses, for example, of a detection signal from a first detector 48 during the drive and obtains the amount of transport at the moment from the counted value. Here, the constant amount L may be the length that is equal to or less than the length corresponding to one round of the roll body R2 when the outer diameter of the winding is maximum, for example. This is for avoiding unnecessary increase in the time required for measuring the outer diameter of the winding due to unnecessary increase in the constant amount L. The constant amount L may be the length that exceeds one round of the roll body R2 with the maximum outer diameter of the winding.

In Step S32, the transport mechanism 23 stops the transport by the constant amount. That is, if the transport position of the medium M in accordance with the amount of transport at the moment reaches a deceleration start position for stopping the medium M at a target position corresponding to the constant amount L, the control unit 41 causes the transport mechanism 23 to start to decelerate and stops the medium M at the target position after the transport by the constant amount L. As a result, loosening corresponding to the constant amount L is formed in the medium M between the transport mechanism 23 and the winding unit 22.

In Step S33, the measurement of the amount of winding rotation is started. That is, the control unit 41 starts to count the number of pulses of a detection signal from a second rotation detector 49 and starts to measure the amount of rotation of the winding unit 22.

In Step S34, the winding operation is started. That is, the control unit 41 starts to drive the winding motor 22M, thereby starting the winding operation of the winding unit 22. As a result, the winding of the medium M by the constant amount L is started. At this time, the amount of winding rotation started in Step S33 is measured.

In Step S35, it is determined whether or not winding load has exceeded a tensile force upper limit value. That is, the control unit 41 obtains winding load on the winding motor 22 M based on a detection signal from the second rotation detector 49 or a command value for the winding motor 22M. Then, the control unit 41 continues the winding operation and the measurement of the amount of winding rotation before the winding load exceeds the tensile force upper limit value (negative in determination in S35). In contrast, if the winding load exceeds the tensile force upper limit value (positive in the determination in S35), the control unit 41 moves on to Step S36, completes the winding operation, and completes the measurement of the amount of winding rotation in Step S37.

In Step S38, the control unit 41 calculates the outer diameter of the winding R by the equation R=L/θw using the amount of winding rotation θw. If the measurement of the outer diameter of the winding is completed, then the control unit 41 completes the routine.

Next, the control unit 41 starts the transport operation of the transport mechanism 23 in Step S22 in FIG. 18 in a stage in which the transport operation is started. Then, the control unit 41 obtains the winding speed Vw after correction (target speed) by correcting the target speed in accordance with the transport distance at the moment from the transport start position set in the speed control profile (see FIG. 9 and FIGS. 14 to 17) for the winding motor read from the storage unit 45 by using a correction value in accordance with the outer diameter of the winding (S23). Then, a CPU 43 of the control unit 41 controls the speed of the winding motor 22M in accordance with the acceleration/deceleration profile obtained by correcting the acceleration/deceleration profile shown in FIG. 9 and FIGS. 14 to 17 by providing a command of the winding speed Vw after the correction as a target value to a control circuit 44. As a result, tensile force adjustment control in which the acceleration/deceleration profile shown in FIG. 9 and FIGS. 14 to 17 is corrected in accordance with the outer diameter of the winding R is performed, and the control of alleviating tensile force generated in the medium M when the tension bar 55 drops on the medium M is further appropriately performed by the tensile force adjustment control.

According to the seventh embodiment, it is possible to precisely perform the tensile force adjustment control regardless of the outer diameter of the winding around the roll body R2 as described above in detail. Therefore, it is possible to further effectively alleviate impact when the tension bar 55 drops on the medium M and to effectively avoid generation of excessive tensile force in the medium M by controlling the winding unit 22 to adjust the moving speed of the medium M. As a result, it is possible to suppress deviation of the transport of the medium M by the transport mechanism 23 and deviation of the winding of the medium M by the winding unit 22.

According to the seventh embodiment, the following effects is obtained as described above in detail.

(13) The control unit 41 obtains the outer diameter of the winding R around the roll body R2 without using the measurement unit 50 and corrects the winding speed Vw of the winding unit 22 in accordance with the outer diameter of the winding R. Therefore, it is possible to appropriately alleviate impact when the tension bar 55 collides against the medium M regardless of the outer diameter of the winding R around the roll body R2 since the winding speed Vw when the winding unit 22 transports the medium M is corrected in accordance with the outer diameter of the winding R around the roll body R2 even if the measurement unit 50 is not provided.

Eighth Embodiment

Next, an eighth embodiment will be described with reference to drawings. The eighth embodiment is different from the other embodiments in content of tensile force adjustment control. The other configurations of a printing apparatus 11 are the same as those in the first embodiment. Hereinafter, the content of control different from those in the other embodiments will be mainly described.

A control unit 41 controls a transport mechanism 23 and a winding unit 22 in the same manner as in the other embodiments. In the embodiment, the control unit 41 controls a transport speed Vf and a winding speed Vw by controlling the speeds of a transport motor 23M and a winding motor 22M in accordance with the acceleration/deceleration profile shown in the other embodiments.

Figure 6:
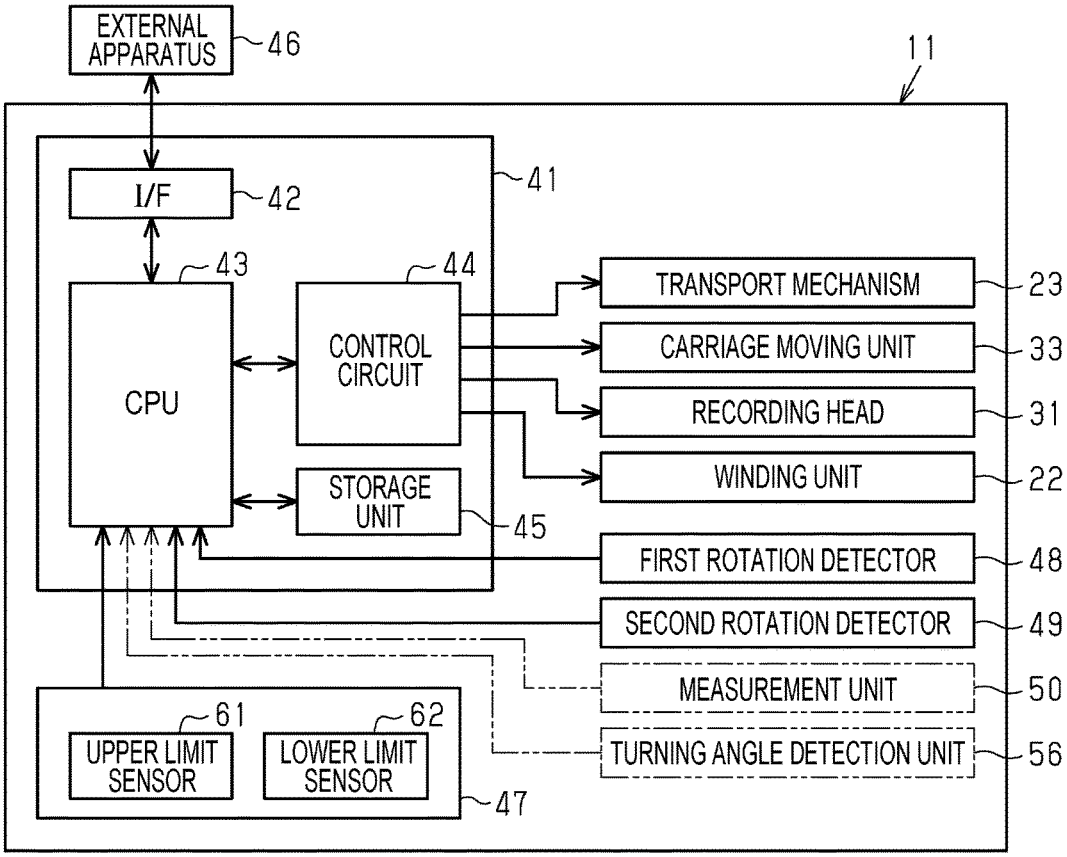
FIG. 6 is a block diagram illustrating an electric configuration of the printing apparatus.

A transport device 12 includes a turning angle detection unit 56 shown by a two-dotted chain line in FIG. 6. The turning angle detection unit 56 detects a turning angle θ (inclination angle) of arms 54 of the tension bar 55. The turning angle detection unit 56 is formed of a rotation detector such as a rotary encoder, for example.

Figure 20:
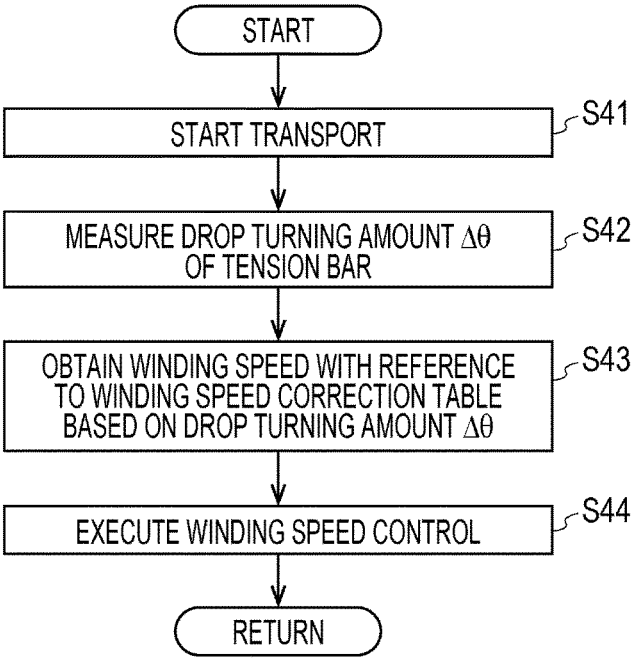
FIG. 20 is a flowchart illustrating tensile force adjustment control according to an eighth embodiment.

A storage unit 45 shown in FIG. 6 stores a tensile force adjustment program shown by the flowchart in FIG. 20. In the embodiment, a winding speed Vw is corrected in accordance with a turning amount Δθ (drop turning amount) from a moving start position (drop start position) of the tension bar 55. Therefore, the storage unit 45 stores a winding speed correction table representing correspondence between the drop turning amount Δθ and the winding speed Vw after the correction.

Also, the storage unit 45 stores at least one of the respective speed control profiles shown in the first to fifth embodiments. In the following description, correction and control of the winding speed Vw is performed in accordance with the speed control profile shown by the two-dotted chain line in FIG. 21 at the time of the correction on the assumption of an example in which the same speed control profile as that in FIG. 9 shown in the first embodiment is used, as shown in FIG. 21.

First, a method of creating a winding speed correction table will be described. Under a condition that the transport speed Vf is constant, a relationship between the amount of transport ΔL of the medium M from a transport start position and a drop distance h (moving distance) until the tension bar 55 drops on the medium M from a drop start position can be defined as h=f (ΔL). From this relationship, the drop distance h (=f (ΔL)) increases as the amount of transport ΔL increases in a case in which the winding unit 22 is not driven. The drop distance h can be adjusted (corrected) to be shorter by the winding unit 22 performing the winding operation during the transport operation of the transport mechanism 23. If the winding unit 22 is driven at the winding speed Vw represented by the solid line of the same acceleration profile as that of the transport speed Vf of the transport mechanism 23 represented by the one-dotted chain line in the graph in the lower section in FIG. 21, the drop distance h can be basically maintained to be substantially constant regardless of the amount of transport ΔL with the partial exception in which the amount of transport ΔL is extremely short. Incidentally, the tension bar 55 slowly starts to move as the moving start position (or the inclination angle θ) of the tension bar 55 is located at a higher position (at an upper limit position P1, for example). Therefore, a difference occurs in the speed when the tension bar 55 collides against the medium M due to a difference in the degrees of acceleration of the tension bar 55 even if the drop distance h is the same. In the example, the winding speed Vw is changed in accordance with a difference in the moving start position of the tension bar 55 in consideration of this point.

Figure 21:
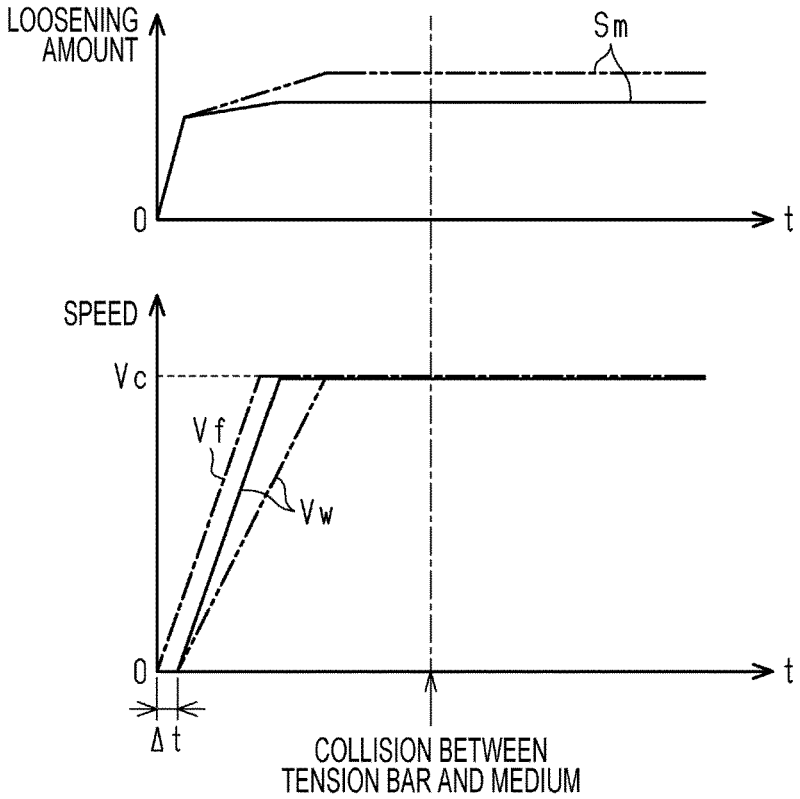
FIG. 21 is a graph illustrating temporal changes in a transport speed, a winding speed, and a loosening amount in tensile force adjustment control.

In the graph in the lower section in FIG. 21, the solid line represents the winding speed Vw set at the moving start position (θ=90°, for example) of the tension bar 55 when the degree of acceleration at the time of start of the moving of the tension bar 55 is the highest, and the two-dotted chain line in the graph represents the winding speed Vw set at the moving start position (the upper limit position P1, for example) when the degree of acceleration at the time of start of the moving of the tension bar 55 is the lowest. A plurality of winding speeds Vw with different degrees of acceleration (hereinafter, also referred to as "degrees of winding acceleration") are set in the process of acceleration in the graph. As for the plurality of winding speeds Vw, the storage unit 45 stores a winding speed correction table that represents correspondence between the drop turning amount Δθ from the moving start position of the tension bar 55 and the winding speed Vw at the moment, for each of a plurality of different moving start positions.

Hereinafter, tensile force adjustment control according to the embodiment will be described with reference to the flowchart shown in FIG. 20.

First, in Step S41, the control unit 41 drives the transport mechanism 23 and causes the transport mechanism 23 to start the transport operation of the medium M. That is, the control unit 41 starts to drive the transport motor 23M at the transport speed in accordance with the acceleration profile stored in the storage unit 45. As a result, the transport mechanism 23 starts the transport operation of feeding the medium M, on which a printing unit 13 has completed printing, toward the downstream side in the transport direction.

In next Step S42, the control unit 41 measures the drop turning amount Δθ of the tension bar 55. The control unit 41 sequentially obtains the turning angle θ at the moment from the turning angle detector 56 after this transport operation is started. The control unit 41 measures the drop turning amount Δθ (=θp−θs) from the differential between the turning angle θs when the tension bar 55 starts to drop and the turning angle θp this time by using the turning angle θp obtained this time.

In Step S43, the control unit 41 obtains the winding speed Vw after correction with reference to the winding speed correction table based on the drop turning amount Δθ.

In Step S44, the control unit 41 performs winding speed control of controlling the speed of the winding unit 22 so as to wind the medium M at the winding speed Vw after the correction. In FIG. 20, for example, one transport operation is performed by repeating the processing in Steps S42 to S44.

For example, the winding speed Vw represented by the two-dotted chain line in FIG. 21 is one when the moving start position of the tension bar 55 is high, and the degree of winding acceleration is lower than that of the winding speed Vw represented by the solid line. That is, a difference ΔVfw between the transport speed Vf and the winding speed Vw increases as the time t after the start of the move of the tension bar 55 elapses. That is, the difference between the transport speed Vf and the winding speed Vw increases as the tension bar 55 drops from the moving start position. In a case in which the moving start position of the tension bar 55 is relatively high (at the upper limit position P1, for example) as shown by the two-dotted chain line in the graph in the upper section in FIG. 21, the loosening amount Sm of the medium M formed until the tension bar 55 collides against the medium M is greater than the loosening amount Sm represented by the solid line in a case in which the moving start position of the tension bar 55 is relatively low (θ=90°, for example). It is possible to adjust the drop distance h by adjusting the winding speed Vw in accordance with the moving start position of the tension bar 55 as described above, to maintain the relative speed therebetween when the tension bar 55 collides against the medium M to be substantially constant, and to thereby alleviate impact of the tension bar 55 on the medium M and suppress variations.

According to the eighth embodiment, the following effect is obtained as described above in detail.

(14) The control unit 41 corrects the winding speed Vw of the winding unit 22 in accordance with the position of the tension bar 55 that has started to drop along with the start of the transport operation of the medium M by the transport mechanism 23. Therefore, it is possible to appropriately alleviate impact when the tension bar 55 collides against the medium M. For example, the difference ΔVfw between the transport speed Vf and the winding speed Vw is relatively large, and the loosening amount Sm is relatively large as the moving start position of the tension bar 55 is located at a higher position. Therefore, it is possible to maintain the relative speed ΔV between the tension bar 55 and the medium M when the tension bar 55 collides against the medium M to be constant regardless of the difference of the moving start position. Therefore, it is possible to effectively alleviate impact and to suppress variations when the tension bar 55 collides against the medium M.

The aforementioned embodiments may be modification examples described below. Also, the configurations included in the respective embodiments and configurations included in the following modification examples may be arbitrarily combined, or the configurations included in the following modification example may be arbitrarily combined.

In the respective embodiments, the aforementioned control of adjusting the relative speed between the tension bar 55 and the medium M may be always performed not only when the tension bar 55 is located at a position that is equal to or greater than the predetermined height but also when the tension bar 55 drops due to the transport of the medium M by the transport mechanism 23.

The tensile force applying member is not limited to the member of the turning type such as the tension bar 55 described in the aforementioned respective embodiments. For example, the tensile force applying member may be a direct acting type of biasing the tensile force applying member so as to be movable in the Y axis direction and biasing the tensile force applying member so as to be movable in the Z axis direction. In such a case, bias force of the tensile force applying member may be generated by power from a drive source such as an electric motor or elastic force of a spring.

A configuration with no counter weight 52 may also be employed.

The printing apparatus is not limited to a serial printer or a line printer and may be a lateral printer in which a carriage can move in two directions, namely a main-scanning direction and a sub-scanning direction.

The printing apparatus is not limited to an ink jet printer and may be an electrophotographic printer, a dot impact printer, a thermal transfer printer, or a textile printing apparatus.

The printing apparatus may use a printing technology, for example, to eject liquid droplets in the form of liquid (ink) in which functional material particles are dispersed or mixed onto a medium made of a thin long base material (substrate) fed from a roll body. For example, the printing apparatus may eject liquid droplets in the form of liquid in which metal powder such as a wiring material is dispersed as the functional material particles and forms an electric wiring pattern on the substrate. The printing apparatus may manufacture pixels of a display (a display substrate for a display device) of various types, such as a liquid crystal type, an electroluminescence (EL) type, and a surface light emitting type, by ejecting liquid droplets in the form of liquid, in which color material (pixel material) powder is dispersed as the functional material particles, onto a long substrate.

This application claims priority under 35 U.S.C. § 119 to Japanese Patent Application No. 2017-014829, filed Jan. 30, 2017. The entire disclosure of Japanese Patent Application No. 2017-014829 is hereby incorporated herein by reference.

What is claimed is:

1. A transport device comprising:

a first transport unit;

a second transport unit that is disposed on a downstream side of the first transport unit in a transport direction;

a tensile force applying unit that has a tensile force applying member that is biased toward a medium between the first transport unit and the second transport unit and applies tensile force to the medium; and a control unit that independently and intermittently drives the first transport unit and the second transport unit, wherein transport start timing of the second transport unit takes place later than transport start timing of the first transport unit, and the first transport unit and the second transport unit transport the medium in parallel.

2. The transport device according to claim 1, wherein the control unit sets a first transport speed at which the first transport unit transports the medium and a second transport speed at which the second transport unit transports the medium to be the same.

3. A printing apparatus comprising:

the transport device according to claim 2; and a printing unit that performs printing on the medium that has been transported by the transport device.

4. The transport device according to claim 1, wherein there is a period during which a second transport speed of the second transport unit is higher than a first transport speed of the first transport unit, and a first transport distance by which the first transport unit transports the medium until the period is completed is longer than a second transport distance by which the second transport unit transports the medium until the period is completed.

5. The transport device according to claim 4, wherein the control unit sets the second transport speed to be higher than the first transport speed and then sets the second transport speed to be lower than the first transport speed.

6. A printing apparatus comprising:

the transport device according to claim 5; and a printing unit that performs printing on the medium that has been transported by the transport device.

7. A printing apparatus comprising:

the transport device according to claim 4; and a printing unit that performs printing on the medium that has been transported by the transport device.

8. The transport device according to claim 1, wherein the control unit sets the transport start timing of the second transport unit to be later than the transport start timing of the first transport unit in a case of the first transport distance, by which the first transport unit transports the medium, being equal to or greater than a predetermined distance and does not drive the second transport unit in a case of the first transport distance being less than the predetermined distance.

9. A printing apparatus comprising:

the transport device according to claim 8; and a printing unit that performs printing on the medium that has been transported by the transport device.

10. The transport device according to claim 1, wherein the control unit performs control such that a second transport speed at which the second transport unit transports the medium follows variations in a first transport speed at which the first transport unit transports the medium.

11. A printing apparatus comprising:

the transport device according to claim 10; and a printing unit that performs printing on the medium that has been transported by the transport device.

12. The transport device according to claim 1, wherein transport stop timing of the first transport unit is the same as transport stop timing of the second transport unit.

13. A printing apparatus comprising:

the transport device according to claim 12; and a printing unit that performs printing on the medium that has been transported by the transport device.

14. The transport device according to claim 1, wherein the second transport unit is a winding unit that winds the medium transported from the first transport unit, and wherein the control unit obtains an outer diameter of the medium wound by the winding unit and corrects a winding speed as a second transport speed, at which the winding unit winds the medium, in accordance with the outer diameter of the wound medium.

15. A printing apparatus comprising:

the transport device according to claim 14; and a printing unit that performs printing on the medium that has been transported by the transport device.

16. The transport device according to claim 1, wherein the control unit corrects a second transport speed, at which the second transport unit transports the medium, in accordance with a position of the tensile force applying member.

17. The transport device according to claim 1, wherein the tensile force applying unit includes a tensile force reducing unit that reduces bias force applied by the tensile force applying member to the medium.

18. A printing apparatus comprising:

the transport device according to claim 1; and a printing unit that performs printing on the medium that has been transported by the transport device.

* * * * *